US007589678B2

(12) United States Patent
Perunka et al.

(10) Patent No.: US 7,589,678 B2
(45) Date of Patent: Sep. 15, 2009

(54) MULTI-BAND ANTENNA WITH A COMMON RESONANT FEED STRUCTURE AND METHODS

(75) Inventors: Jari Perunka, Tupos (FI); Kimmo Koskiniemi, Oulu (FI)

(73) Assignee: Pulse Finland Oy (FI)

( * ) Notice: Subject to any disclaimer, the term of this patent is extended or adjusted under 35 U.S.C. 154(b) by 301 days.

(21) Appl. No.: 11/544,173

(22) Filed: Oct. 5, 2006

(65) Prior Publication Data

US 2007/0159399 A1 Jul. 12, 2007

(51) Int. Cl.
*H01Q 1/24* (2006.01)

(52) U.S. Cl. ..... 343/702; 343/700 MS

(58) Field of Classification Search ..... 343/700 MS, 343/702
See application file for complete search history.

(56) References Cited

U.S. PATENT DOCUMENTS

| | | | | |
|---|---|---|---|---|
| 5,557,292 | A | 9/1996 | Nygren et al. | |
| 5,966,097 | A * | 10/1999 | Fukasawa et al. | 343/700 MS |
| 6,166,694 | A * | 12/2000 | Ying | 343/702 |
| 6,316,975 | B1 | 11/2001 | O'Toole et al. | |
| 6,326,921 | B1 * | 12/2001 | Egorov et al. | 343/700 MS |
| 6,473,056 | B2 | 10/2002 | Annamaa | |
| 6,606,016 | B2 | 8/2003 | Takamine et al. | |
| 6,614,400 | B2 | 9/2003 | Egorov | |
| 6,862,441 | B2 | 3/2005 | Ella | |
| 7,057,560 | B2 * | 6/2006 | Erkocevic | 343/700 MS |
| 7,068,230 | B2 * | 6/2006 | Qi et al. | 343/702 |
| 7,142,824 | B2 | 11/2006 | Kojima et al. | |
| 7,148,849 | B2 | 12/2006 | Lin | |
| 7,148,851 | B2 | 12/2006 | Takaki et al. | |
| 7,170,464 | B2 | 1/2007 | Tang et al. | |
| 7,176,838 | B1 | 2/2007 | Kinezos | |

(Continued)

FOREIGN PATENT DOCUMENTS

DE 101 50 149 A1 4/2003

(Continued)

OTHER PUBLICATIONS

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., pp. 15-24, waelsall@rockwellcollins.com and blhauck@rockwellcollins.com.

(Continued)

*Primary Examiner*—Tho G Phan
(74) *Attorney, Agent, or Firm*—Gazdzinski & Associates, PC

(57) ABSTRACT

A multi-band antenna and associated apparatus for communication systems and other applications. In one embodiment, a common junction network is provided having a first and a second radiator. The first radiator resonates in a first frequency band. The second radiator resonates in a second frequency band. The first and second frequency bands are different from one another (yet may overlap). A first electrical component is coupled to the common junction network and proximately located to the first radiator. The first electrical component creates a resonance with the common junction network to create a third frequency band proximate to the first frequency band. The first radiator is capable of communicating RF energy in the first frequency band and the third frequency band.

30 Claims, 18 Drawing Sheets

U.S. PATENT DOCUMENTS

| | | | | |
|---|---|---|---|---|
| 7,180,455 | B2 | 2/2007 | Oh et al. | |
| 7,205,942 | B2 | 4/2007 | Wang et al. | |
| 7,218,282 | B2 | 5/2007 | Humpfer et al. | |
| 7,224,313 | B2 | 5/2007 | McKinzie, III et al. | |
| 7,274,334 | B2 | 9/2007 | O'Riordan et al. | |
| 7,283,097 | B2 | 10/2007 | Wen et al. | |
| 7,289,064 | B2 | 10/2007 | Cheng | |
| 7,292,200 | B2 | 11/2007 | Posluszny et al. | |
| 7,330,153 | B2 | 2/2008 | Rentz | |
| 7,333,067 | B2 | 2/2008 | Hung et al. | |
| 7,339,528 | B2 | 3/2008 | Wanf et al. | |
| 7,345,634 | B2 | 3/2008 | Ozkar et al. | |
| 7,358,902 | B2 | 4/2008 | Erkocevic | |
| 7,411,556 | B2 * | 8/2008 | Sanz et al. | 343/702 |
| 2004/0021607 | A1 | 2/2004 | Legay | |
| 2004/0212493 | A1 | 10/2004 | Stilp | |
| 2005/0024268 | A1 | 2/2005 | McKinzie, III et al. | |
| 2005/0243001 | A1 | 11/2005 | Miyata et al. | |
| 2007/0152881 | A1 | 7/2007 | Chan | |
| 2007/0241970 | A1 | 10/2007 | Thornell-Pers | |
| 2007/0268190 | A1 | 11/2007 | Huynh | |
| 2007/0273606 | A1 | 11/2007 | Mak et al. | |
| 2007/0290938 | A1 | 12/2007 | Loyet | |
| 2008/0042903 | A1 | 2/2008 | Cheng | |

FOREIGN PATENT DOCUMENTS

| | | | |
|---|---|---|---|
| EP | 0 831 547 | A2 | 3/1998 |
| EP | 1 162 688 | A1 | 12/2001 |
| EP | 1 791 213 | | 5/2007 |
| WO | WO 02/11236 | A1 | 2/2002 |
| WO | WO 2004/112189 | A1 | 12/2004 |
| WO | WO 2006/000650 | | 1/2006 |

OTHER PUBLICATIONS

Product of the Month, RFDesign, "GSM/GPRS Quad Band Power Amp Includes Antenna Switch," 1 page, reprinted Nov. 2004 issue of RF Design (www.rfdesign.com), Copyright 2004, Freescale Semiconductor, RFD-24-EK.

* cited by examiner

MULTI-BAND ANTENNA WITH A COMMON RESONANT FEED STRUCTURE AND METHODS

PRIORITY

This application claims priority to Finland Patent Application Serial No. 20055527, filed on Oct. 10, 2005, entitled "Multi-band Antenna System", which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The invention relates generally to the field of radio frequency antennas, and in one exemplary aspect to a multi-band antenna apparatus having radiating elements for different resonance frequencies.

2. Description of Related Technology

Wireless communication devices and systems have been allocated multiple frequency ranges. For instance, wireless communication devices, e.g., handsets may communicate using frequency domains such as Bluetooth, Global System for Mobile Communication (GSM) 850, 900, 1800, and 1900, WCDMA, CDMA2000, WiMAX, and IEEE Std. 802.11 a/b/g/n. However, several issues may exist for antennas included within, for example, handsets that communicate in multiple frequency ranges.

Some of these issues relate to establishing acceptable tradeoffs between antenna size, efficiency, reliability, and cost. Because wireless communication devices are generally shrinking in size and the quantity of electronic device features is generally increasing, a very limited volume exists for antenna deployment. Thus, a smaller volume/footprint antenna would be ideal. However, antenna size, footprint, and cross-sectional area must be considered and to some degree "traded-off" against antenna performance considerations.

For instance, conventional Planar Inverted F-Antennas (PIFAs) designed to fit in a very small area, such as those attached to a rear portion of a computer screen display, have only sufficient bandwidth to cover a limited frequency range, such as 4.9 GHz to 5.85 GHz, but not also a frequency range centered at about half this value, e.g., 2.5 GHz. Furthermore, even if a conventional PIFA is modified by splitting its radiating plane into two separate frequency bands, this antenna will typically display poor antenna voltage standing wave ratio (VSWR) and radiating efficiency. Consequently, current PIFA topologies do not adequately address multiple antenna frequency concerns, e.g., simultaneously covering frequency bands of 850 MHz and 1800 MHz, and respective sideband frequencies of 900 MHz and 1900 MHz.

In contrast to PIF-antennas, conventional multi-band antenna systems generally occupy a comparatively larger area or volume. This large required area results from the multi-band antenna having both multiple arrays of radiating elements and adjoining corporate feed structures each tuned to a distinct frequency along a desired multi-band frequency band or spectrum. Conventional corporate feed structures are exemplified in the paper "*A Novel Approach of a Planar Multi-Band Hybrid Series Feed Network for Use in Antenna Systems Operating at Millimeter wave Frequencies*" by M. W. Elsallal, et al, incorporated herein by reference in its entirety. In this paper, a planar multi-band hybrid series feed network is disclosed.

More specifically, the planar multi-band hybrid series feed network uses numerous series coupled lines to create a high complexity resonance structure. The series coupled lines contain multiple sub-tap lines. Multiple sub-taps lines are provided for each frequency band of interest. Band pass filters tune the resonance response of the multiple sub-tap lines to the desired frequency band. Outputs of the tuned sub-tap lines are combined after a filtering stage to achieve a multi-band frequency antenna spectrum. However, one drawback of this approach is that as more frequency operating bands are created, the circuit occupies a wider surface area, because each additional operating frequency band requires another band pass filter including sub-taps lines. Consequently, compact device packaging of the planar multi-band hybrid antenna into a small area can be very troublesome.

Furthermore, traditional feed structures, disclosed in the above paper, do not address and/or provide an adequate solution to decrease overall surface area for inclusion of this type of multi-band antenna into a wireless device package. The wireless device package may include e.g., a case for laptop computer, or housing for a conventional cellular phone or wireless personal digital assistant (PDA) device. In addition, even if area is not an issue, there are still an inherent limit on efficiency and bandwidth of large sized antennas. Such limits include inter alia undesired frequency moding and unpredictable floating ground issues, e.g., create poor antenna performance, such as increasing antenna Voltage Standing Wave Ratio (VSWR).

Other generally representative multi-band antenna systems include those described in United States Patent Application Publication No. US 2005/0024268 to McKinzie III et al. entitled "Multi-band Antenna with Parasitically-Coupled Resonators" published Feb. 3, 2005. In this publication, a multi-band antenna is formed using a parasitic coupled resonator, e.g., attached to a ground plane, that does not touch the antenna's feed structure. As shown in the publication, this topology has inherent performance issues because of the addition of the (parasitic) coupled resonator may also decrease the bandwidth of the original resonator.

U.S. Pat. No. 6,606,016 to Takamine et al. entitled "Surface Acoustic Wave Device Using Two Parallel Connected Filters with Different Passbands" published on Aug. 12, 2003 discloses a hardware intensive multi-band system that requires two different passband filters.

U.S. Pat. No. 6,862,441 to Ella entitled "Transmitter Filter Arrangement for Multi-band Mobile Phone" issued on Mar. 1, 2005 discloses using two different passband amplifiers and a band-reject filter to achieve a limited frequency bandwidth dual-mode 1800-1900 performance, e.g., less than 100 MHz bandwidth.

United States Patent Application Publication No. 2004/0021607 to Legay entitled "Multisource Antenna, in Particular for Systems with a Reflector" published on Feb. 5, 2004 discloses a complex hardware architecture having at least two interleaved radiating apertures and at least two excitation sources to achieve a multi-band antenna.

Thus, improved apparatus and methods are needed for communicating a multi-band signal that have advantages over the complex feed networks and radiating structures described above. Ideally, the improved apparatus and methods would have, inter alia, (i) minimal complexity, i.e., a minimal number of components, radiating elements and interconnections; (ii) occupy a comparatively small volume and/or area; and (iii) exhibit good radiating efficiency and voltage standing wave ratio (VSWR) performance over the frequency operating band(s) of interest for its size.

SUMMARY OF THE INVENTION

The present invention satisfies the foregoing needs by providing, inter alia, an improved multi-band antenna structure and associated methods of operation and manufacturing.

In one aspect of the invention, a multi-band antenna is disclosed. In one embodiment, the multi-band antenna comprises a common junction RF network, which comprises a first and a second radiator. The first radiator resonates in a first frequency band, and the second radiator in a second frequency band. In one variant, the first frequency band and the second frequency band are different frequency bands from one another. In another variant, the frequency bands may overlap one another to some degree. Furthermore, the exemplary embodiment may include a first electrical component coupled to the common junction network, which is located proximate to the first radiator. The first electrical component creates a resonance with the common junction network to create a third frequency band generally proximate to the first frequency band. Furthermore, the first radiator is capable of communicating RF energy in the first frequency band and the third frequency band.

In a second aspect of the invention, an antenna system is disclosed. In one embodiment, the antenna system includes at least two radiators that resonate at different frequency bands, and a resonant network. The resonant network couples between the at least two radiators. In addition, the resonant network provides an adjacent frequency band to at least one of the different frequency bands for at least one of the at least two radiators.

In a third aspect of the invention, a method is disclosed for increasing an effective bandwidth of a multi-band antenna. In one embodiment, the method comprises providing at least two radiators that resonate at different frequency bands. An RF feed is connected to the at least two radiators, forming a common junction network. A first electrical component is connected along the RF feed proximal to a first radiator of the at least two radiators, adding an adjacent frequency band to a first frequency band of the first radiator.

In a fourth aspect of the invention, a method of operating a multi-band antenna is provided. In one embodiment, the method comprises: providing a multi-band antenna structure comprising a first and a second radiator and a first electrical component coupled to the common junction network, which is located proximate to the first radiator; operating the first radiator so as to resonate in a first frequency band; operating the second radiator so as to resonate in a second frequency band; and creating a resonance with the common junction network using said first component to create a third frequency band generally proximate to the first frequency band.

In a fifth aspect of the invention, a method of manufacturing a multi-band antenna structure is disclosed.

In a sixth aspect of the invention, a wireless device comprising a multi-band antenna is disclosed. In one embodiment, the wireless device comprises a mobile handheld device such as a cellular telephone or PDA.

In a seventh aspect of the invention, a wireless system comprising-two or more a multi-band antennas communicating with one another is disclosed.

In an eighth aspect of the invention, a radio frequency identification (RFID) tag utilizing a multi-band antenna is disclosed. In one embodiment, the tag comprises a flexible substrate, passive RFID tag compliant with the EPC GEN2 standard. The tag comprises a processor (e.g., microprocessor), associated memory, and passive energization circuitry, and is adapted to receive and/or backscatter RF energy at two or more frequencies.

In a ninth aspect of the invention, a multi-band-enabled modular jack or connector is disclosed. In one embodiment, the jack comprises an RJ45 jack with integral radio suite, and integral multi-band antenna formed at least in part of the jack's external noise shield.

These and other embodiments, aspects, advantages, and features of the present invention will be set forth in part in the description which follows, and in part will become apparent to those skilled in the art by reference to the following description of the invention and referenced drawings or by practice of the invention.

DETAILED DESCRIPTION

Figure 1:
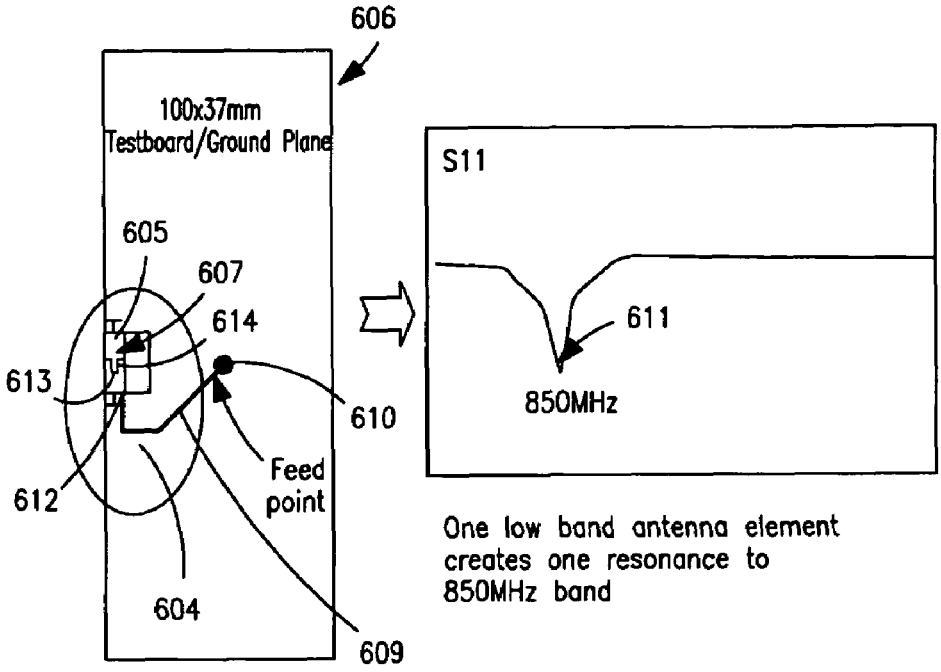
FIG. 1 is a top plan view and performance plot of a first frequency band antenna in accordance with one embodiment of the present invention.

Reference is now made to the drawings wherein like numerals refer to like parts throughout.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component.

As used herein, the terms "radiator," "radiating plane," and "radiating element" refer without limitation to an element that can function as part of a system that receives/transmits radio-frequency electromagnetic radiation; e.g., an antenna.

The terms "feed," "RF feed," "feed conductor," and "feed network" refer to without limitation to any energy conductor and coupling element(s) that can transfer energy, transform impedance, enhance performance characteristics, and conform impedance properties between an incoming/outgoing RF energy signals to that of one or more connective elements, such as for example a radiator.

Furthermore, the terms "antenna," "antenna system," and "multi-band antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

The terms "communication systems" and communication devices" refer to without limitation any services, methods, or devices that utilize wireless technology to communicate information, data, media, codes, encoded data, or the like from one location to another location.

The terms "frequency range", "frequency band", and "frequency domain" refer to without limitation any frequency range for communicating signals. Such signals may be communicated pursuant to one or more standards or air interfaces such as e.g., Bluetooth; WiFi; Stream; Edge; Global System for Mobile Communication (GSM) 850, 900, 1800, and 1900; UMTS, WCDMA, CDMA2000, or IEEE Std. 802.11a/b/g/n, or the like.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination.

As used herein, the term "integrated circuit (IC)" refers to any type of device having any level of integration (including without limitation ULSI, VLSI, and LSI) and irrespective of process or base materials (including, without limitation Si, SiGe, CMOS and GaAs). ICs may include, for example, memory devices (e.g., DRAM, SRAM, DDRAM, EEPROM/Flash, ROM), digital processors, SoC devices, FPGAs, ASICs, ADCs, DACs, transceivers, memory controllers, and other devices, as well as any combinations thereof.

As used herein, the term "memory" includes any type of integrated circuit or other storage device adapted for storing digital data including, without limitation, ROM. PROM, EEPROM, DRAM, SDRAM, DDR/2 SDRAM, EDO/FPMS, RLDRAM, SRAM, "flash" memory (e.g., NAND/NOR), and PSRAM.

As used herein, the terms "microprocessor" and "digital processor" are meant generally to include all types of digital processing devices including, without limitation, digital signal processors (DSPs), reduced instruction set computers (RISC), general-purpose (CISC) processors, microprocessors, gate arrays (e.g., FPGAs), PLDs, reconfigurable compute fabrics (RCFs), array processors, and application-specific integrated circuits (ASICs). Such digital processors may be contained on a single unitary IC die, or distributed across multiple components.

As used herein, the terms "network" and "bearer network" refer generally to any type of telecommunications or data network including, without limitation, wireless networks (e.g., cellular or other), hybrid fiber coax (HFC) networks, satellite networks, telco networks, micronets, piconets, and data networks (including MANs, WANs, LANs, WLANs, internets, and intranets). Such networks or portions thereof may utilize any one or more different topologies (e.g., ring, bus, star, loop, etc.), transmission media (e.g., wired/RF cable, RF wireless, millimeter wave, optical, etc.) and/or communications or networking protocols (e.g., SONET, DOCSIS, IEEE Std. 802.3, ATM, X.25, Frame Relay, 3GPP, 3GPP2, WAP, SIP, UDP, FTP, RTP/RTCP, TCP/IP, H.323, etc.).

As used herein, the term "Wi-Fi" refers to, without limitation, any of the variants of IEEE-Std. 802.11 or related standards including 802.11 a/b/g/n.

As used herein, the term "wireless" means any wireless signal, data, communication, or other interface including without limitation Wi-Fi, Bluetooth, 3G, HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, analog cellular, CDPD, satellite systems, millimeter wave or microwave systems, acoustic, and infrared (i.e., IrDA).

As used herein, the terms "mobile device", "client device", "peripheral device" and "end user device" include, but are not limited to, personal computers (PCs) and minicomputers, whether desktop, laptop, or otherwise, set-top boxes such as the Motorola DCT2XXX/5XXX and Scientific Atlanta Explorer 2XXX/3XXX/4XXX/8XXX series digital devices, personal digital assistants (PDAs) such as the "Palm®" or Blackberry families of devices, handheld computers, personal communicators, J2ME equipped devices, cellular telephones, personal integrated communication or entertainment devices such as the Apple iPod® or LG VX8500 Chocolate devices, or literally any other device capable of interchanging data with a network or another device.

Overview

In one salient aspect, the present invention discloses an antenna having multiple frequency bands for use in communication systems. In the exemplary embodiment of this antenna, a common junction network provides a first and second radiator. The first radiator resonates in a first frequency band. The second radiator resonates in a second frequency band. The first and second frequency bands may be different frequency bands from one another, or may overlap. A first electrical component is coupled to the common junction network and proximately located to the first radiator. The first electrical component creates a resonance with the common junction network to create a third frequency band proximal to the first frequency band. The first radiator is capable of communicating RF energy in the first frequency band and the third frequency band. Consequently, the present invention may be used to communicate over a wide frequency range (or ranges) between a wireless communication device, e.g., cell phone, personnel communication device (PDA), personal computer, laptop computer or the like.

Broadly, the present invention generally provides a system and method for increasing the operating frequency of an existing antenna system so that one antenna may be utilized for multiple frequency domains. Although the following discussion is cast primarily in terms of use for multi-band communication systems (e.g., cellular or other wireless communications networks) as an exemplary demonstration, it is to be understood that this discussion is not limiting and that the present invention may be used in other suitable applications. For example, the system of the present invention may find beneficial use for providing a network manager an opportunity to switch system circuitry of a local access network (LAN) to a second frequency band server to trouble shoot and/or perform system maintenance of a first frequency band server without the need for changing antennas. Similarly, a home or residential gateway device may be equipped with a common antenna for multiple air interfaces (such as PAN, Bluetooth, and WiFi).

In yet another aspect, the system may prove useful for detecting shifts in frequency of an incoming signal using multiple frequency bands. More specifically, the system may be part of an inventory or identification system that monitors object movement information and/or provides redundant tracking information using multiple frequency bands. Thus, an operator would have the ability to track objects in separate frequency bands. In addition, the antenna may be adaptable to a warehouse and/or manufacturing setting, such as where vehicles, goods, and merchandise are binned or stored, e.g., utilizing RFID or similar technology adapted for multiple frequency bands.

In addition, wile one embodiment of the invention is described using at least two ceramic blocks, elements, or radiators for a mobile handheld communication device for 850 MHz, 900 MHz, 1800 MHz, and 1900 MHz frequency bands, the principles and methods of this invention may further be applied just as readily to other technologies, frequency ranges, frequency domains, or other products. Other frequency ranges may include for example the 2.4-2.5 GHz range (commonly associated with Bluetooth and WiFi), 5-6 GHz (e.g., 5.8 GHz) or the like, and the other applications may include global positioning systems (GPS) satellites or receivers, tracked objects, and so forth.

Advantageously, the antenna system of the present invention does not require direct line-of-sight, and the system may effectively be applied to both indoor situations, such as for local area networks (LANs), satellite reception devices, satellite television receivers, as well as for outdoor systems such as those utilized for locating and tracking individuals and objects.

Moreover, it will be recognized that the present invention may find utility beyond voice, data or media communication or tracking systems. For example, the "radiating elements" described subsequently herein may conceivably be utilized to improve other applications; e.g., in a microwave oven or other magnetron device to, for example, cook food items using a different RF frequency wavelength for different entree items.

Other functions might include grocery store check out lines that utilize wireless technology, such as Radio Frequency Identification Device (RFID) tags. For instance, a grocery store may scan consumer items using a multi-band antenna. In this situation, consumer product information may be tracked/monitored using multiple operating frequencies. Therefore, the grocery store checkout lines may use one multi-band antenna and monitor merchandise using multiple frequency bands, such as using a first frequency band for one function (e.g., to monitor product expiration dates and store location codes), and a second frequency band to monitor other information (such as production information, number of inventory items, duration for reordering or selling a particular item at a discount, and so forth). Myriad of other functions will be recognized by those of ordinary skill in the art given the present disclosure.

The improved antenna disclosed herein may also be used for control system applications, such as those that wirelessly monitor components such as transducers, sensors, and electrical and/or optical components within a manufacturing or industrial process.

The antenna apparatus described herein may also feasibly be integrated into a modular jack or connector (e.g., RJ 45 network device), such as by using the technology described in co-pending U.S. patent application Ser. No. 60/_____ entitled "SHIELD AND ANTENNA CONNECTOR APPARATUS AND METHODS" filed Oct. 2, 2006 and incorporated herein by reference in its entirety.

Exemplary Antenna Apparatus—

Referring now to FIGS. 1-8, exemplary embodiments of the multi-band antenna system of the invention are described in detail.

It will be appreciated that while exemplary embodiments of the antenna of the invention are implemented using ceramic technology due to its desirable attributes and performance, the invention is in no way limited to ceramic-based configurations, and in fact can be implemented using other technologies.

FIG. 1 illustrates one embodiment of a first frequency band antenna in accordance with an embodiment of the present invention, as well as a performance plot relating thereto. A first ceramic block 605 is attached, e.g., by epoxy, to a board, e.g., PCB 606, with a lower surface thereof directly or indirectly coupled to the board 606. In one alternative embodiment, the first ceramic block 605 may be replaced by or used in conjunction with other types of radiating structures, such as metallized patches, horn radiators, layered and/or composite materials, or the like that have the capability to radiate RF energy. An antenna feed conductor 609, in this example, comprises a conductive metal strip such as a microstrip or stripline transmission line. In an alternative embodiment, the antenna feed conductor 609 may be any material, strip, conductive film, or conductive ink that has the capability to transport an electrical signal, such as that relating to an incoming or outgoing RF signal.

The antenna feed conductor 609 is located on an upper surface of the board 606 and substantially surrounded, in this example, by a ground plane 604. In one alternative embodiment, the ground plane 604 is disposed along only certain sides (e.g., one side) of the conductor 609. At a first end, the feed conductor 609 is attached at a first position 612 along a first ceramic block 605. The first ceramic block 605, in this example, is a frequency resonant structure that has inherent resonance characteristics tunable to a desired frequency bandwidth/range. Information on exemplary structures that may be utilized for the first ceramic block 605, second ceramic block 615, and network configurations for utilizing these blocks is disclosed in International Publication Number WO 2006/000650 A1 entitled "Antenna Component" filed on Jun. 28, 2005, published on Jan. 5, 2006, to Sorvala, et al. which content is hereby incorporated by reference in its entirety, although it will be appreciated by those of ordinary skill that other approaches may be substituted as well.

In the illustrated embodiment of FIG. 1, the first position 612 acts as a tuning element to alter/enhance inherent resonance properties of the first ceramic block 605. At a second end, the feed conductor 609 is attached to a feed point 610 that connects RF energy for either transmission from or to the first ceramic block 605. The ground plane 604 may also optionally be tapered (not shown) along the first feed conductor 609 to adjust its characteristic impedance. In other words, the ground plane 604 acts as a tuning element to achieve desired resonance performance for the first ceramic block 605.

Furthermore, an operating frequency of approximately 850 MHz (611) of the first ceramic block 605 is adjusted by adding a metal conductor; e.g., on an upper surface of the ceramic block 605. To achieve the approximate operating frequency 850 MHz (611) in this example, the metal conductive material comprises a meander radiator 607. The meander radiator 607 includes conductive metal, such as for example gold, silver, titanium, platinum, a composite conducting material, or the like, deposited using one or more standard metallization techniques, although other approaches may be used as well. Standard metallization techniques include e.g., etching a metallized board using photolithographic techniques, epoxy bonding, and/or solder bonding one or more conductive metals to the surface of the first ceramic block 605.

The meander radiator 607 transmits/receives wireless communication energy, such as analog, digital, microwave, millimeter wave, or a combination thereof. In one alternative embodiment, the conductive metal may be replaced by any conductive strip, ribbon, or ink deposited or chemically disposed on the board 606. The meander radiator 607, as shown in FIG. 1, may have a number of turns that are of a desired shape (e.g., rectangular) in nature. In this example, a width 613 and a length 614 are fabricated to achieve a desired center resonance frequency 611, which, in this exemplary embodiment, is approximately 850 MHz.

Figure 2A:
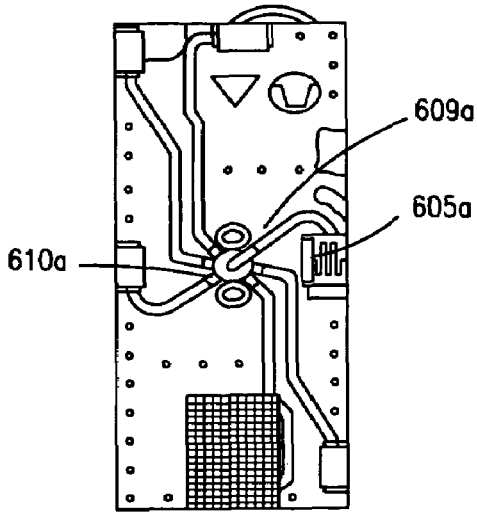
FIG. 2A is an elevational view illustrating an exemplary board layout for the circuitry of FIG. 1.
Figure 2B:
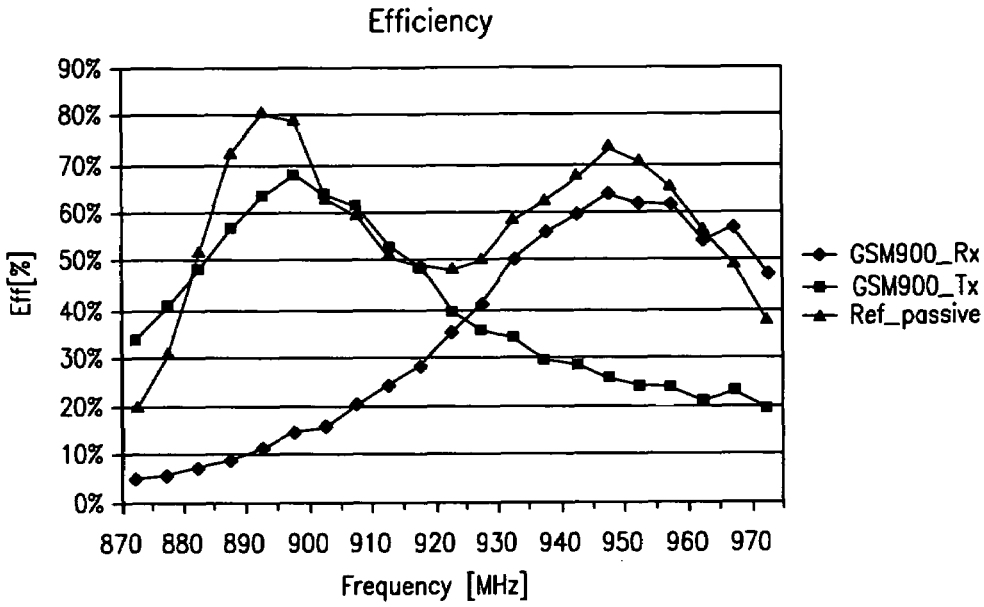
FIGS. 2B and 2C are graphs illustrating measured performance for the exemplary device of FIG. 2A.
Figure 2C:
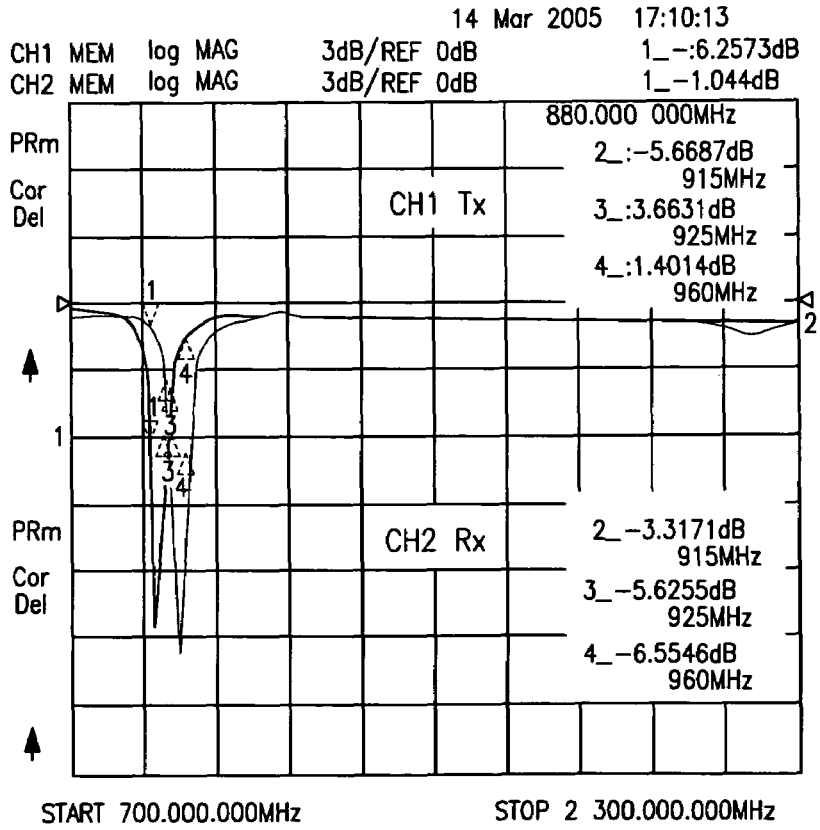

FIG. 2A shows a representative board layout having attributes and components similar to those discussed in connection with FIG. 1. In addition, FIGS. 2B and 2C are measured performance plots in connection with the representative board layout depicted in FIG. 2A. As can be seen from the exemplary results in FIGS. 2B and 2C, a relatively good radiation efficiency is achieved using this configuration. It should also be noted that the antennas are selective (i.e., provide a bandpass or narrowband "filter" response of sorts). This response is desirable, especially within a multi-antenna environment, since it provides benefits in terms of, inter alia, isolation and possible interference rejection. For example, in devices with a diversity receiver, narrowband-selective antennas are useful in that they provide improved isolation with respect to other co-located antennas, and further improve the performance of the diversity receiver due to greater immunity to interfering signals.

Figure 3:
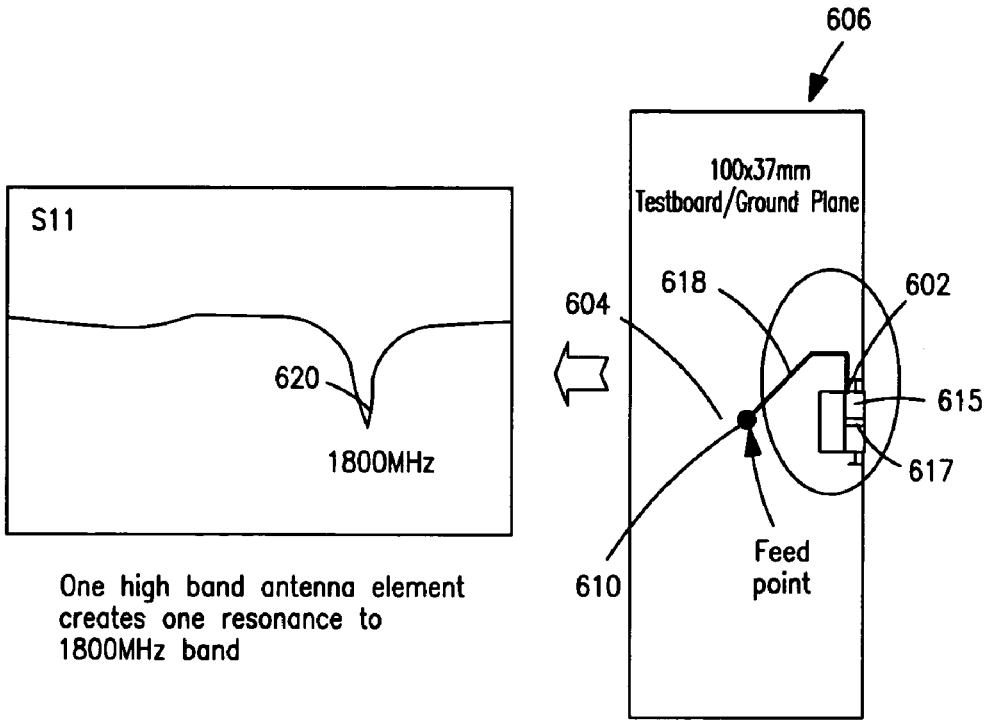
FIG. 3 is a top plan view and performance plot of a second frequency band antenna in accordance with one embodiment of the present invention.

Furthermore, such immunity inherent in ceramic antenna technology also provides improved performance when compared to conventional so-called "air insulated" technologies such as PIFA's. Detuning (frequency shift) of the ceramic antenna when placed for example close to human hand or head is much lower than with conventional technologies resulting better overall performance FIG. 3 illustrates a second frequency band antenna in accordance with an embodiment of the present invention, as well as an associated performance plot. In this embodiment, the second ceramic block 615 is attached, e.g., by an epoxy substance, to a substrate such as a printed circuit board (PCB) 606, with its lower surface (not shown) directly or indirectly contacting the board 606. As discussed with respect to the first block, the second ceramic block 615 may be replaced by a radiating patch, horn, structure, layered material, or composite material that may efficiency receive and transmit RF energy. An antenna feed conductor 618 in this example comprises a conductive metal strip, but in an alternative embodiment may comprise any material, strip, conductive film, or conductive ink that has the capability to transport an electrical signal.

The antenna feed conductor 618 is located on an upper surface of the board 606. Similar to the embodiment of FIG. 1, the ground plane 604 in this example substantially surrounds or is along at least one side of the feed conductor 618 to form a feed line of selected characteristic impendence. At a first end, the feed conductor 618 is attached to a second position 602 along the second ceramic block 615. At a second end, the feed conductor 618 is attached to a feed point 610 that connects RF energy for either transmission from or to the second ceramic block 615. Similar to ground plane 604 in FIG. 1, the ground plane 604 herein may be tapered to adjust a characteristic impedance of the conductor 618, thereby acting as a tuning element for the second ceramic block 615.

Furthermore, an operating frequency 620 of the second ceramic block 615 can be adjusted by changing the location that the conductor 618 attaches to the second ceramic block 615. To achieve the approximately operating frequency 1800 MHz, in this example, a metallized radiator 617 has been implemented by depositing conductive metal, such as gold, on an upper surface of the second ceramic block 615. The attachment processes are similar to that of the meander conductor 607 associated with FIG. 1, although a heterogeneous process may be used if desired.

In the alternative, the conductive metal of the metallized radiator 617 may be replaced by or substituted for any conductive strip, ribbon, or ink. The radiator 617, in this example, comprises a single strip conductor. In the alternative, the single strip conductor may be any size or shape item that will support a desired resonance frequency for the second ceramic block 615. The width and length of the metallized radiator 617 are fabricated to achieve a desired resonance frequency, which, in this exemplary example, is approximately 1800 MHz.

Figure 4A:
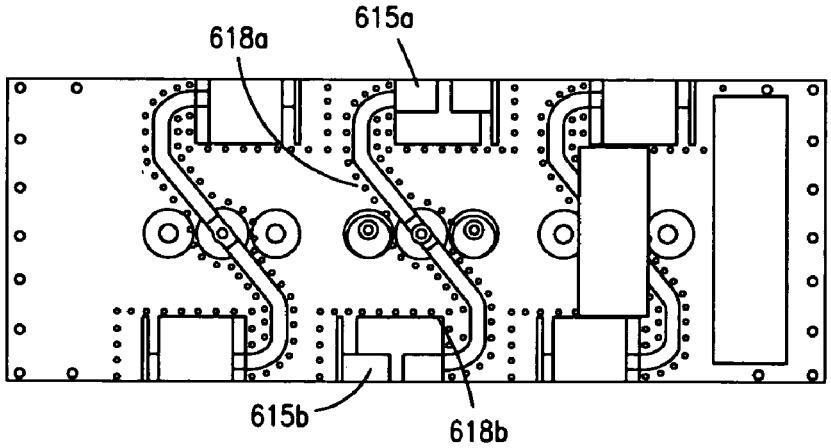
FIG. 4A is an elevational view illustrating an exemplary board layout for the circuitry of FIG. 3.
Figure 4B:
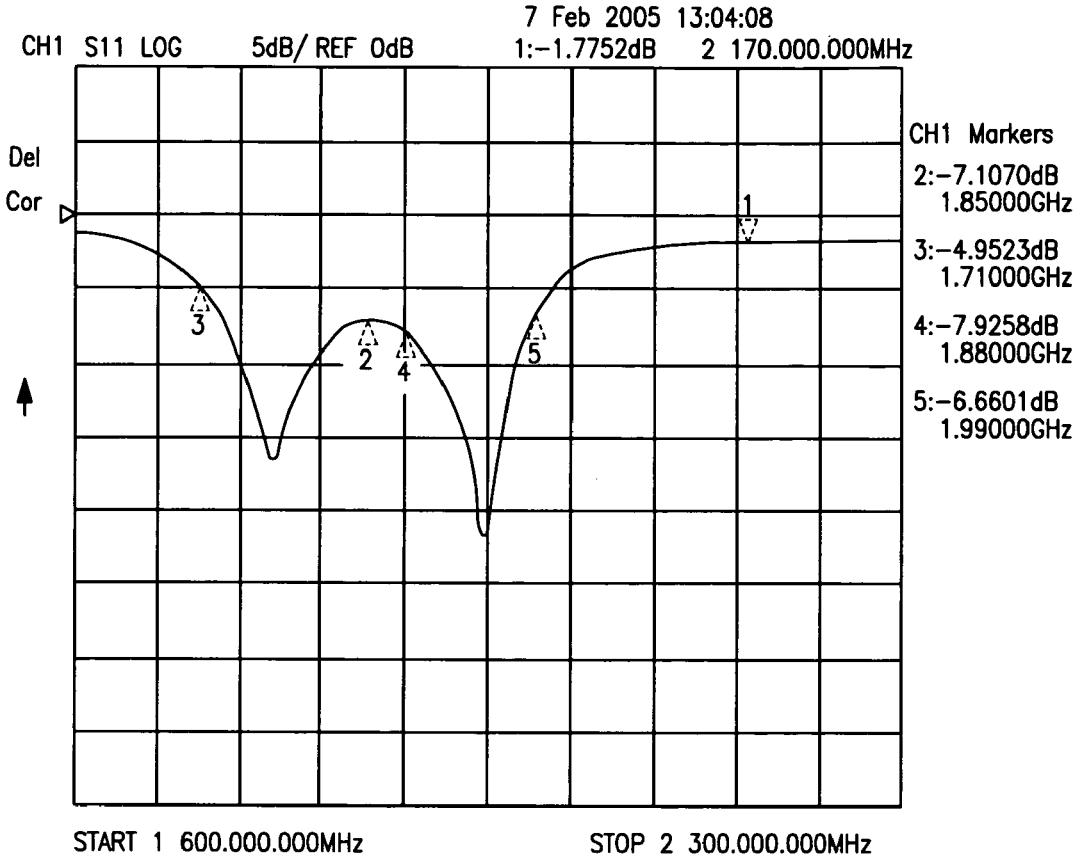
FIGS. 4B and 4C are graphs illustrating measured performance for the exemplary device of FIG. 4A.
Figure 4C:
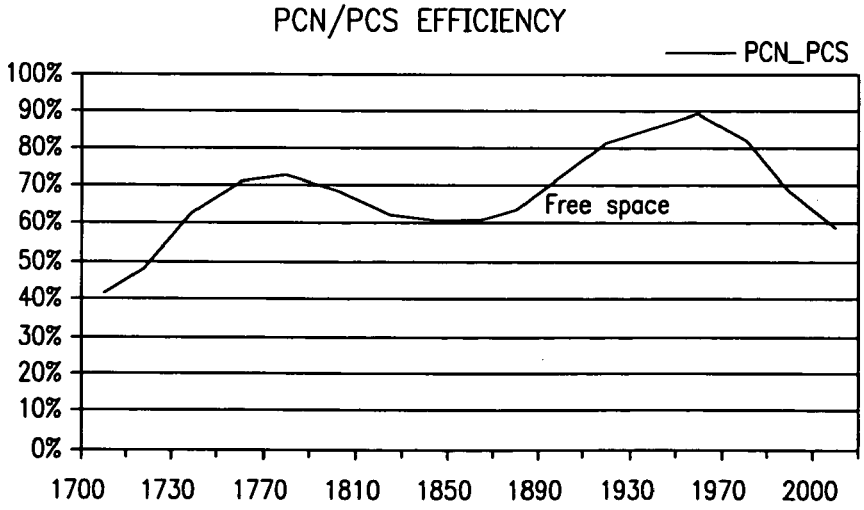

FIGS. 4A, 4B, and 4C graphically illustrate the principles discussed with reference to FIG. 3. More specifically, the exemplary board layout shown in FIG. 4A illustrates a representative approach for implementing the circuit of FIG. 3. FIGS. 4B and 4C depict measured performance plot for the board layout of FIG. 4A.

Figure 5A:
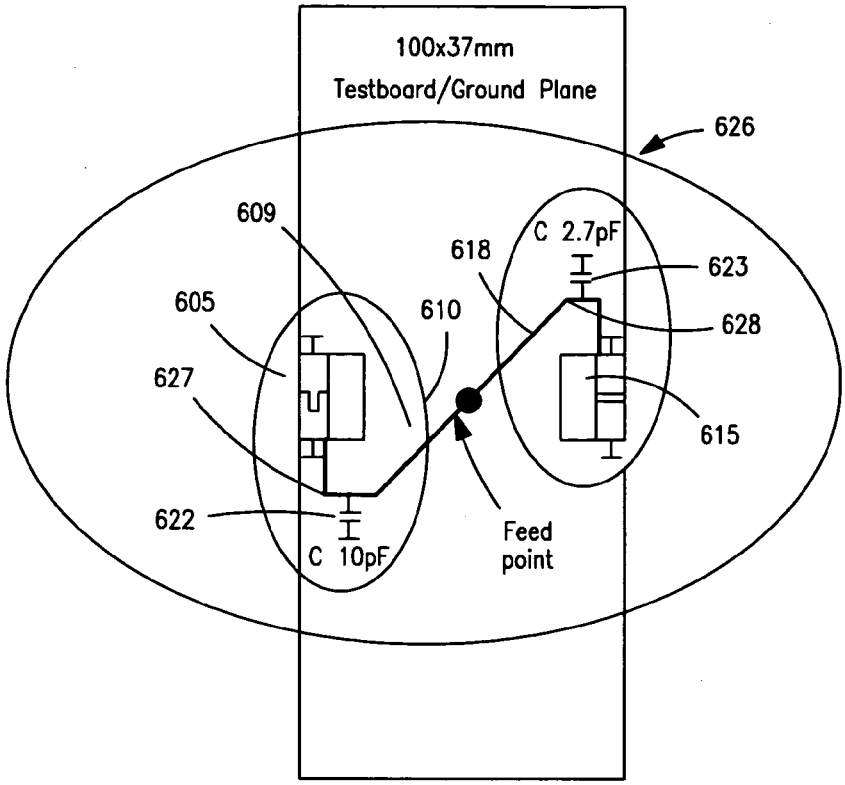
FIG. 5A is a plan view of a quad-band antenna including electrical circuitry in accordance with another embodiment of the present invention.
Figure 5B:
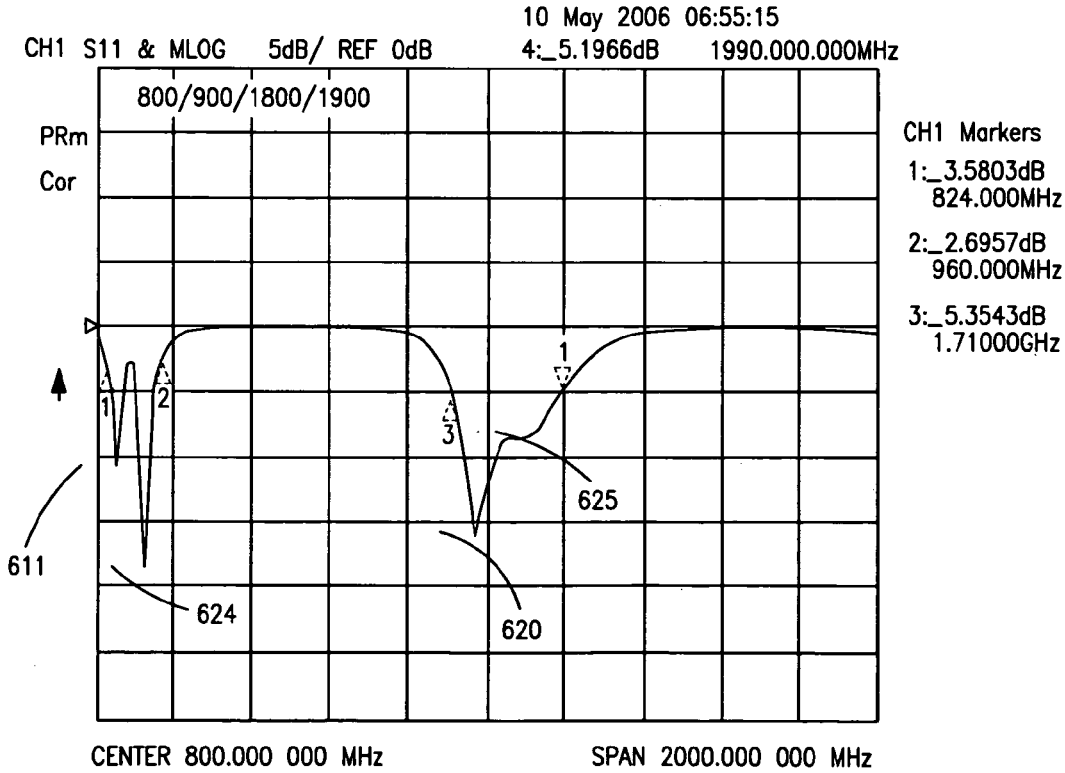
FIGS. 5B, 5C, and 5D are graphs illustrating measured input return loss, resonance bands, and antenna efficiency performance, respectively, for the exemplary quad-band antenna of FIG. 5A.
Figure 5C:
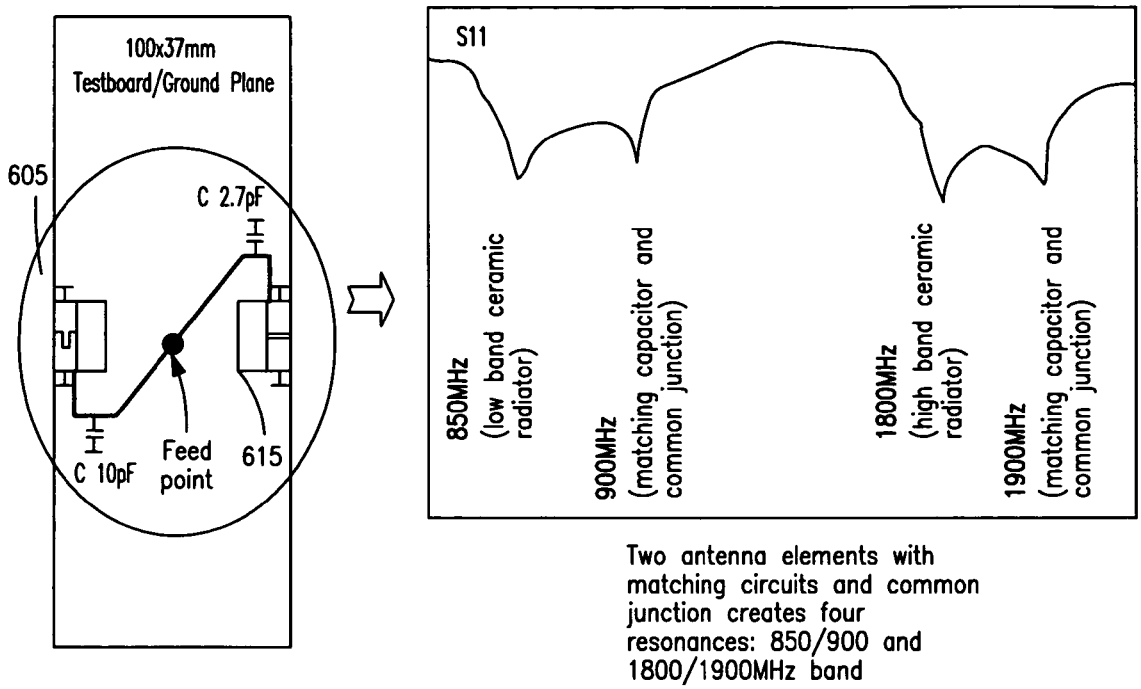

FIG. 5A illustrates a schematic representation of one embodiment of a quad-band antenna according to the invention. FIGS. 5B, 5C, and SD are representative plots of the performance of this quad-band antenna. In the embodiment of FIG. 5A, the feed conductor 609 of the apparatus of FIG. 1 is connected to the feed conductor 618 of the apparatus of FIG. 2 at a feed point 610. Additionally, discrete components, e.g., charge storage devices, are used in the circuit. In this exemplary embodiment, the charge storage devices include a first capacitor 622 (in this instance 10 pf) being attached along a first location 627 of the feed conductor 609, and a second capacitor 623 (in this instance 2.7 pf) attached along a second location 628 of the feed conductor 618.

The first capacitor 622 and the second capacitor 623 of FIG. 5A add resonances, e.g., increase operating bandwidths for the first 605 and the second 615 ceramic blocks, respectively. In other words, the first capacitor forms within the network 626 an additional resonance at approximately 900 MHz (624). Furthermore, the second capacitor forms within the network 626 an additional resonance at approximately 1900 MHz (625). More specifically, the first capacitor 622, when interacting with the network 626, creates a third frequency resonance 624 for the first ceramic block 605. The third frequency resonance 624 in this example is selected so as to be slightly higher than the first frequency resonance of the first ceramic block. Furthermore, the second capacitor 623 causes a fourth frequency resonance 625 being slightly higher than the second frequency for the second ceramic block 615.

Figure 5D:
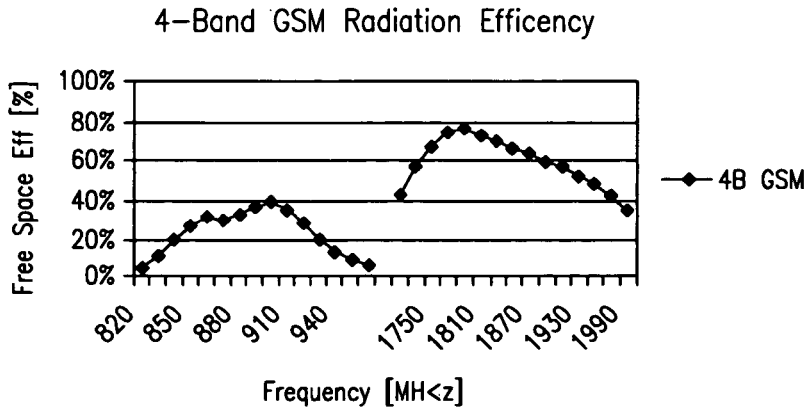

Referring to FIG. 5B and 5C, predicted and measured input return losses respectively are displayed for the exemplary quad-band antenna of FIG. 5A. FIG. 5D depicts greater than 35% efficiency for the bands centered roughly at 850 MHz and 900 MHz, and greater than 60% efficiency for the bands centered at roughly 1800 MHz and 1900 MHz. Consequently, this embodiment of the invention effectively converts a dual-band antenna into a quad-band antenna, e.g., adding a second frequency resonance to a first ceramic radiator and adding a fourth resonance frequency to a second ceramic radiator.

The invention advantageously provides a more compact, wider frequency bandwidth antenna than conventional multi-band antennas, yet without requiring additional radiator elements. Thus, the invention avoids unnecessary costs and hardware (adding additional radiators, additional feed structures, etc.) without requiring complicated matching and radiator patterns of conventional multi-band antenna designs. In other words, the network 626, in this example, includes a common junction resonant network that provides the unexpected result of converting one or more single frequency radiators, e.g., each of the first and the second ceramic blocks 605, 615 respectively, that are part of dual-band antenna, to form a quad-band antenna. This conversion process takes place, in this example, with minimal additional components, e.g., one discrete component such as a shunt capacitor that is disposed at a desired location, e.g., to increase desired operating frequency performance and maintain circuit compactness, along a feed conductor for each single frequency radiator. It will be appreciated, however, that other structures or approaches to converting such radiating elements to have multiple bands may be used consistent with the invention.

Figure 6A:
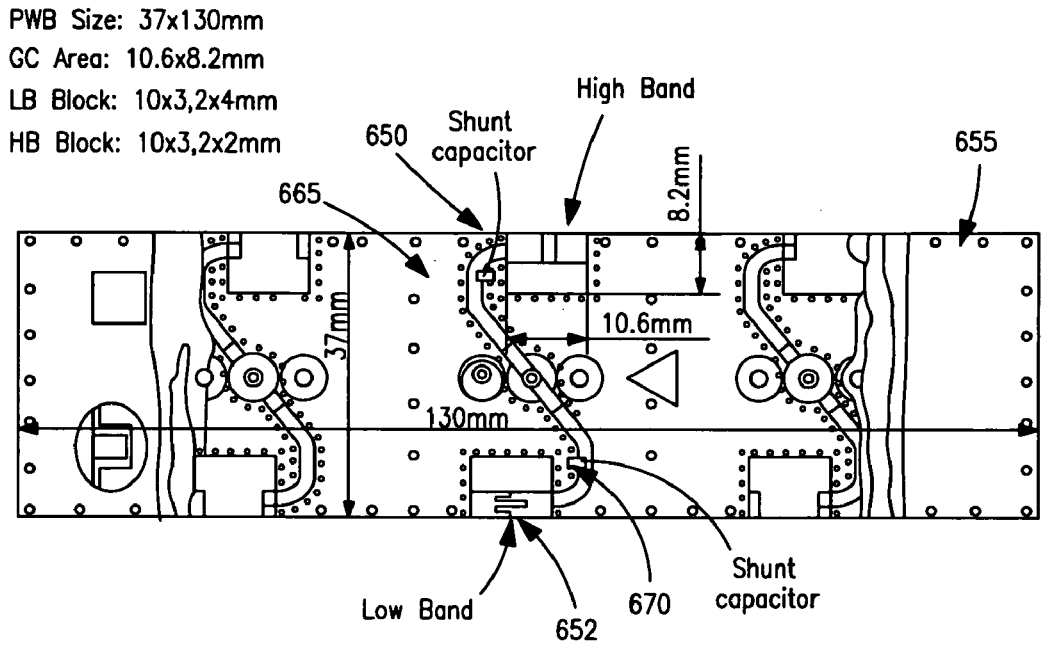
FIG. 6A is an elevational view illustrating an exemplary board layout of a quad-band antenna in accordance with one embodiment of the invention.

Moreover, the described common junction circuit or network can be integrated and formed by using separate components such as for example and without limitation LTCC, multilayer PCB, thin film structures, etc. The antenna elements can also be embedded into a cavity on the PCB to further reduce the total height of the assembly FIG. 6A illustrates an exemplary board layout for a quad-band antenna in accordance with the present invention. In this embodiment, a high frequency band radiator block 650 with dimensions of 10 mm wide by 3 mm long is used in conjunction with a low frequency band radiator block 652 having dimensions of 10 mm wide ×3 mm long, these components being mounted to a board 655. The board 655, e.g., a printed circuit board (PCB), has dimensions of 37 mm wide by 130 mm long. The shunt capacitors 665, 670 are respectively attached proximate to the high frequency band radiator block 650 and the low frequency band radiator block 652. The shunt capacitor 655 adds a resonance of approximately 900 MHz to the low frequency band ceramic block radiator 652. The shunt capacitor 670 adds a resonance of approximately 1900 MHz to the high frequency band radiator block 650.

Figure 6B:
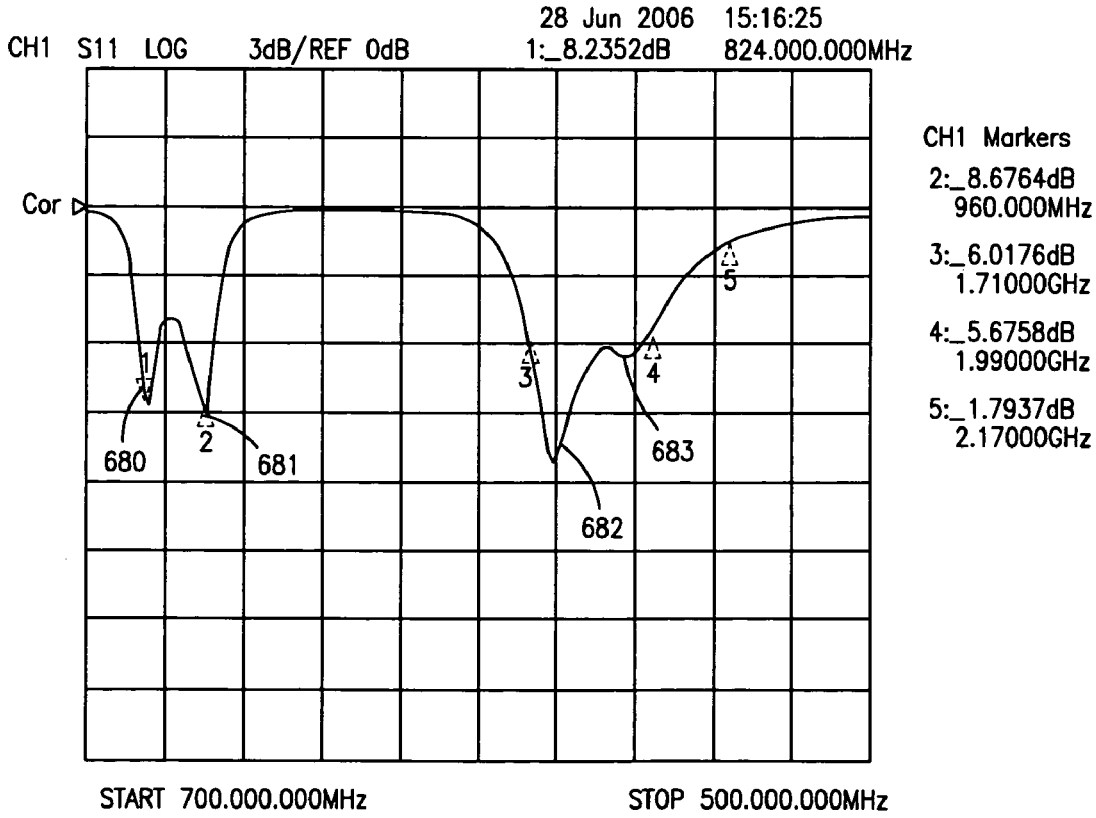
FIGS. 6B, 6C, and 6D are graphical performance plots displaying input return loss, antenna efficiency, and maximum gain of the exemplary quad-band antenna of FIG. 6A.
Figure 6C:
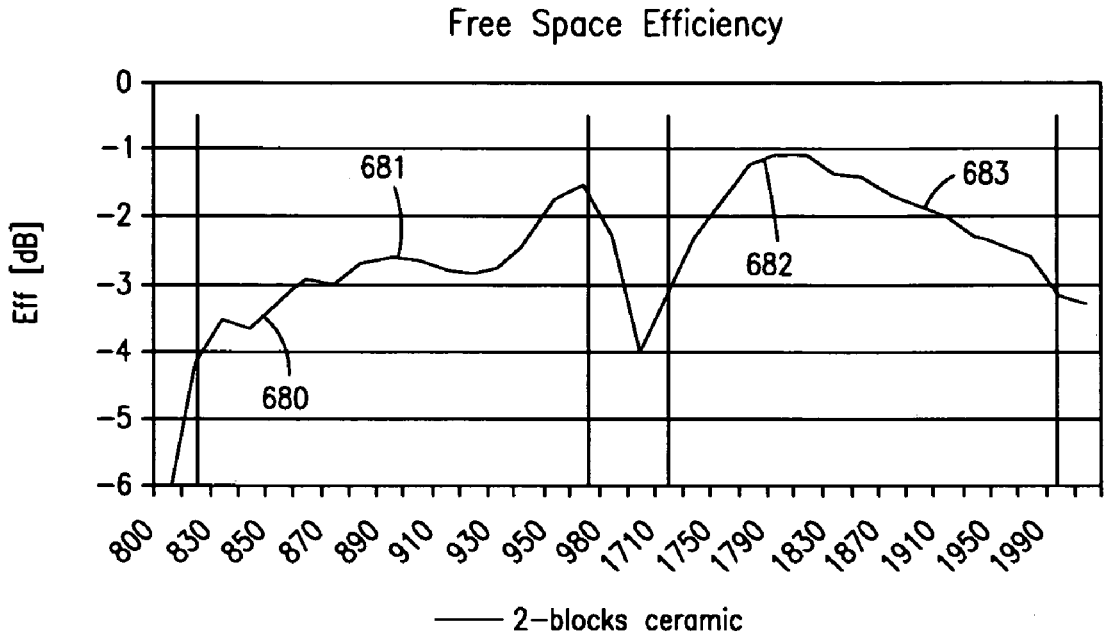
Figure 6D:
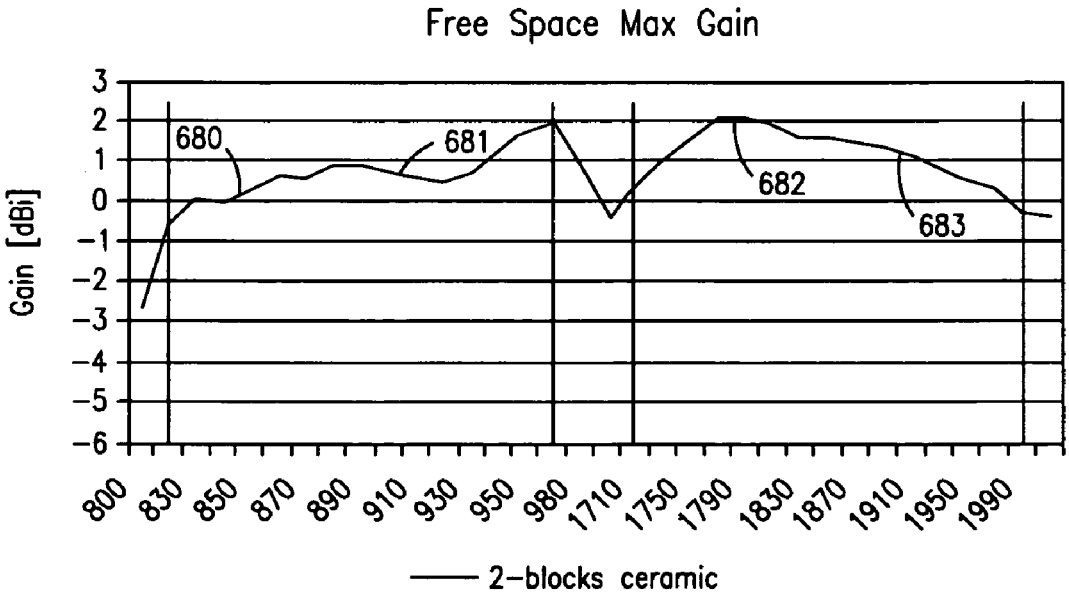

FIGS. 6B, 6C, and 6D are performance plots displaying input return loss, antenna efficiency, and maximum gain, respectively of the exemplary quad-band antenna for FIG. 6A. As shown, four frequency resonances 680, 681, 682, and 683 each advantageously display a measured response of greater than 12 dB return loss (see FIG. 6B). Furthermore, the quad-band antenna has a measured free-space efficiency of greater than −3.5 dB (see FIG. 6C). Finally, the quad-band antenna has a measured free-space gain maximum greater than 0 dBi (see FIG. 6D).

Figure 7A:
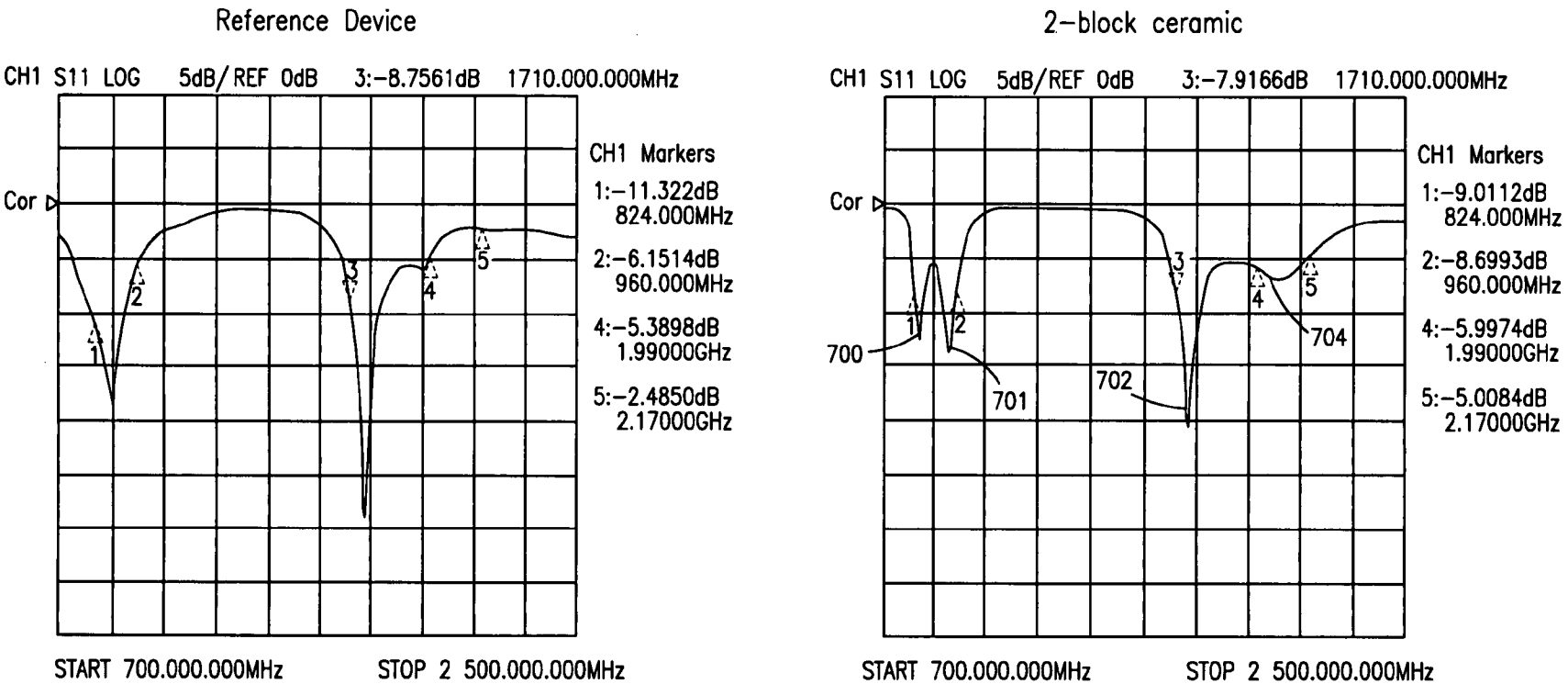
FIG. 7A illustrates measured input return loss of a prior art reference device (monopole antenna) as compared to one exemplary embodiment of multi-band antenna (4-band GSM with 2 ceramic block) in accordance with the present invention.

FIG. 7A illustrates measured input return loss of a prior art reference device (monopole antenna) as compared to one exemplary embodiment of multi-band antenna (4-band GSM with 2 ceramic block) in accordance with the present invention. For purposes of the data shown in FIG. 7A (and also FIG. 7C discussed below), the reference device comprised a commercially available monoblock phone with full mechanics, having an overall size of 113×49 mm, and a bottom-mount monopole antenna with total antenna volume (antenna plus ground clearance area) of approximately 4203 $mm^3$.

Figure 7B:
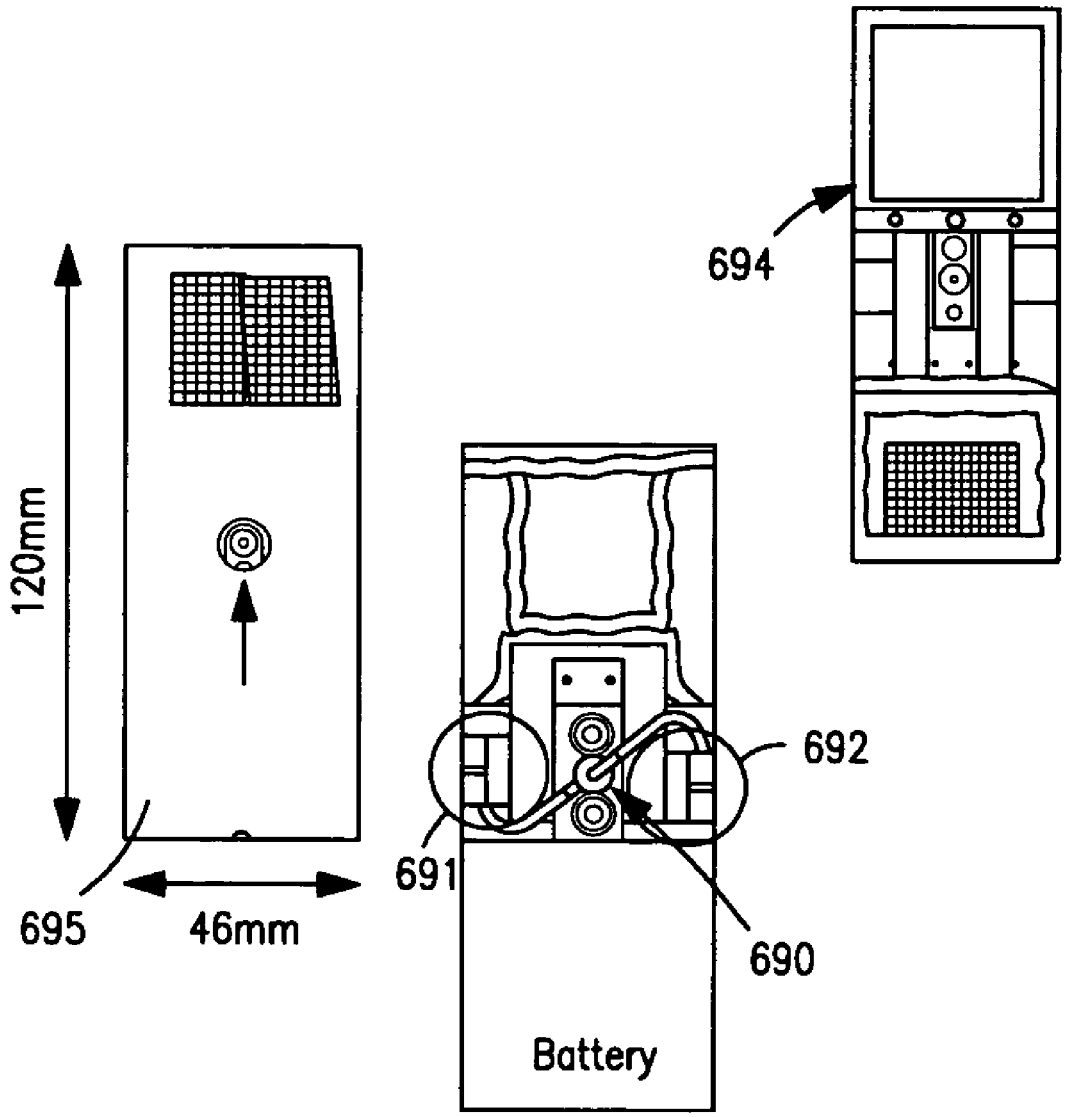
FIG. 7B illustrates an exemplary wireless handheld device configuration, including board layout, incorporating the multi-band antenna of FIG. 7A.

FIG. 7B illustrates an exemplary wireless handheld device configuration, including board layout, incorporating the multi-band antenna of FIG. 7A. The board layout includes a high frequency block radiator plus shunt capacitor network 691 and a low frequency block radiator and shunt capacitor network 692 are attached to a feed point 690. A display 694 and plastic case 695 were also added for the purposes of testing. The total volume of the multi-band antenna shown in FIG. 7B (including antennas and ground clearance area) was approximately 520 $mm^3$, much less than that consumed by the prior art (reference) antenna discussed above.

Figure 7C:
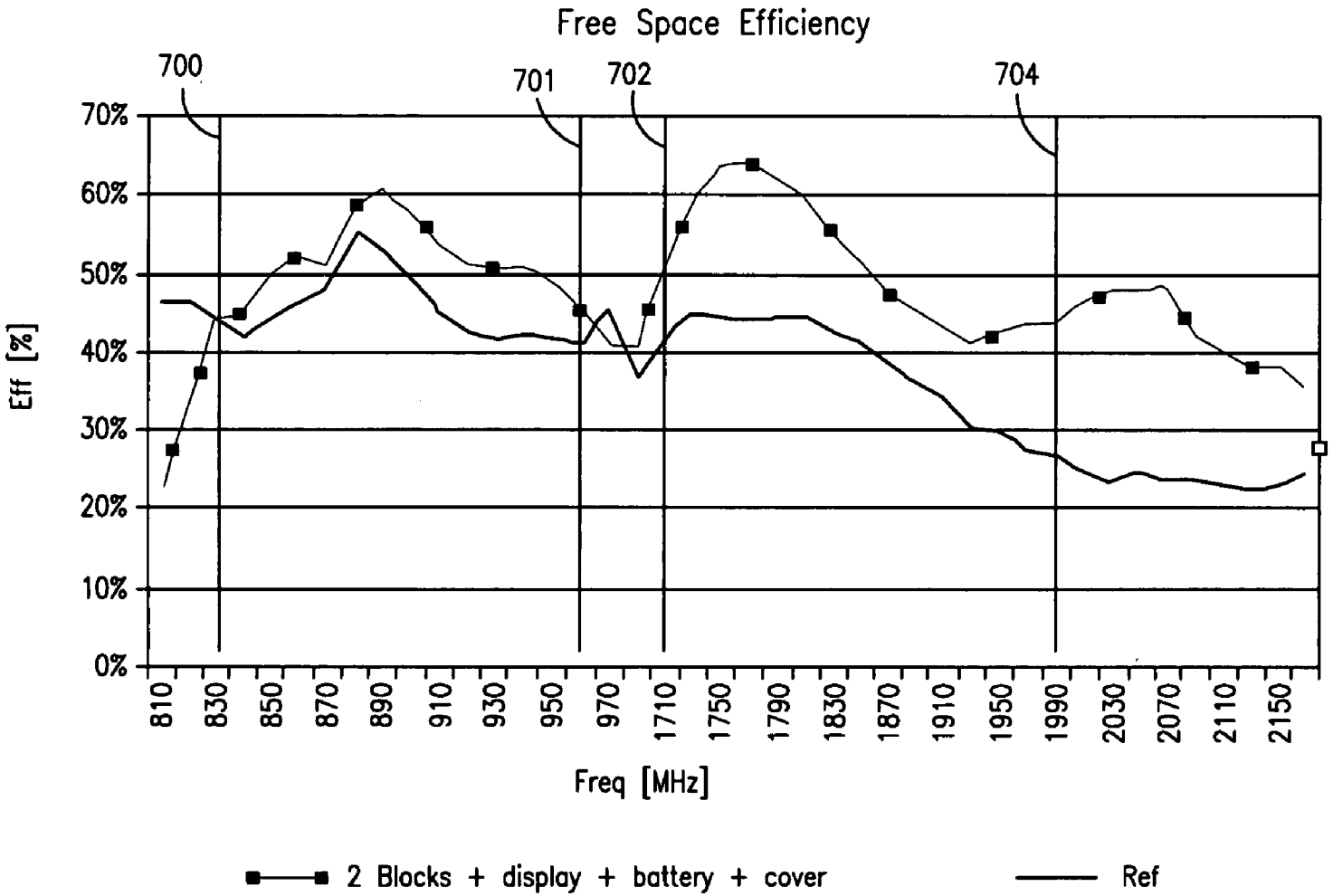
FIG. 7C is a free-space efficiency plot for the multi-band ceramic antenna of FIG. 7A versus the reference monopole device.

FIG. 7C is a free-space efficiency plot for the multi-band ceramic antenna of FIG. 7A versus the reference monopole device.

As shown in FIGS. 7A and 7C, all four-frequency resonances, e.g., 700, 701, 702, and 704 of the multi-band ceramic antenna of the present invention advantageously display excellent return loss performance (FIG. 7A) and high free-space efficiency (FIG. 7C).

Figure 8A:
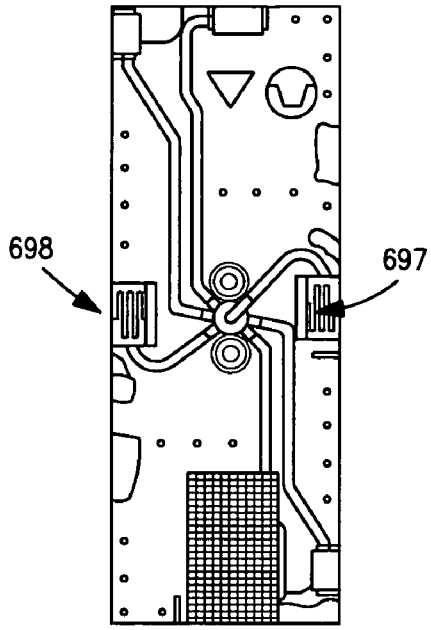
FIG. 8A is a top elevational view illustrating an exemplary board layout of an 850 MHz and 900 MHz frequency range dual-block antenna in accordance with an embodiment of the invention.

FIG. 8A illustrates an exemplary board layout supporting an 850 MHz and 900 MHz frequency range dual-block antenna in accordance with another embodiment of the present invention. On this device, dual blocks of approximate frequency ranges of 850 MHz (698) and 900 MHz (697) are tuned for peak transmitter and receiver functionality.

Figure 8B:
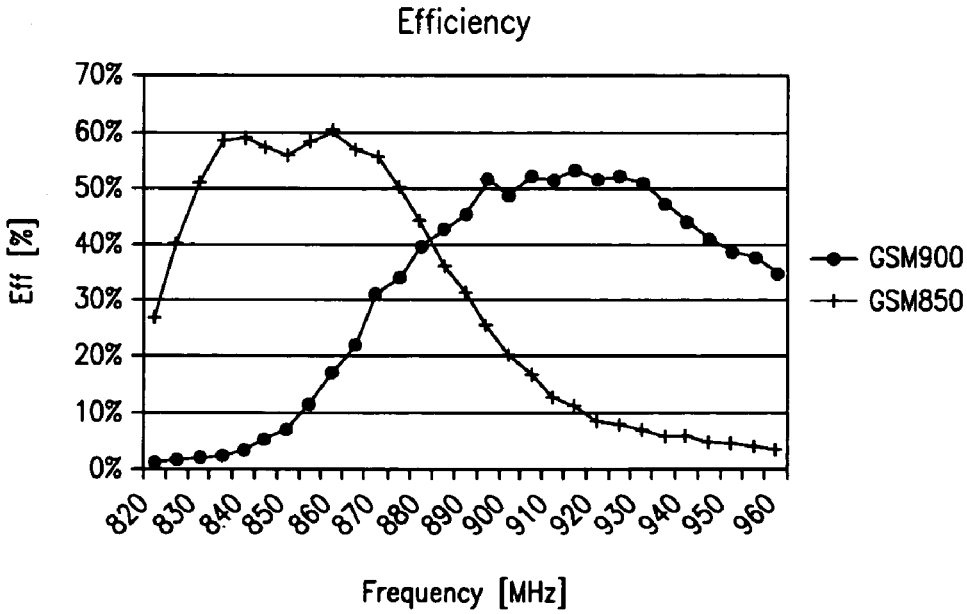
FIGS. 8B and 8C are performance plots displaying input return loss and antenna efficiency of the device of FIG. 8A.
Figure 8C:
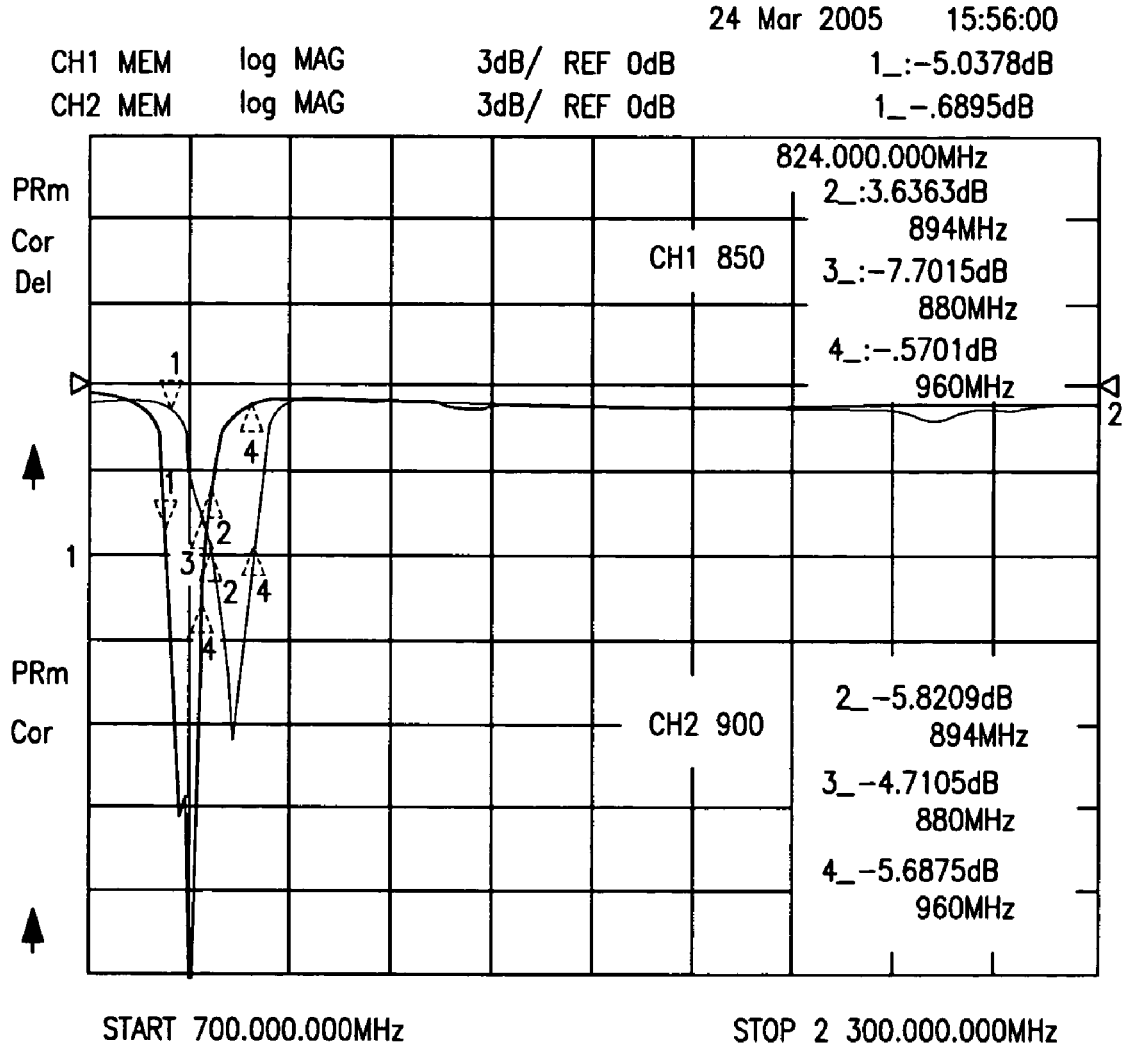

FIGS. 8B and 8C are performance plots displaying antenna efficiency and input return loss for the circuit of FIG. 8A.

Radio Frequency Identification—

As previously described, the exemplary multi-band antenna configurations described herein save appreciable on space and the number of components required to provide the desired multi-band functionality. Accordingly, this makes these implementations useful for low-cost, space-critical applications such as the well known RFID "tag". For example, one variant of the invention comprises a flexible substrate (e.g., adhesive label), passive RFID tag adapted to comply with the so-called "EPC GEN2" standard (i.e., "EPC Radio Frequency Identity Protocols—Class-1 Generation—2 UHF RFID Protocol for Communications at 860 MHz-960 Mhz, Version 1.09"), incorporated herein by reference in its entirety. Exemplary radio frequency identification devices and methods of manufacture suitable for use with the multi-band antenna of the present invention are described in, e.g., U.S. Pat. No. 6,316,975 to O'Toole, et al. issued Nov. 13, 2001 and entitled "Radio frequency data communications device", which is incorporated herein by reference in its entirety, and accordingly are not described further herein.

Advantageously, the use of a multi-band antenna (and associated transceiver within the tag, and the interrogator) allows for a greater degree of operational flexibility and capabilities not found in single-band tags. For example, each of the multiple bands can be used for different functions (e.g., backscatter of reply versus receipt of a command), thereby helping to reduce or avoid communication collisions. Additionally, the two bands can be used as a coincidence circuit in order to increase reliability; i.e., logic coupled to each or a subset of the bands would require a common output before an action is taken (e.g., a tag "kill" command or random number generation operation is implemented, etc.). Alternatively, the multiple bands may be used as backups or redundant channels to one another, wherein physical phenomenon associated with one frequency band may not adversely affect another band, etc.

Head- and Hand-Effects—

Figure 9A:
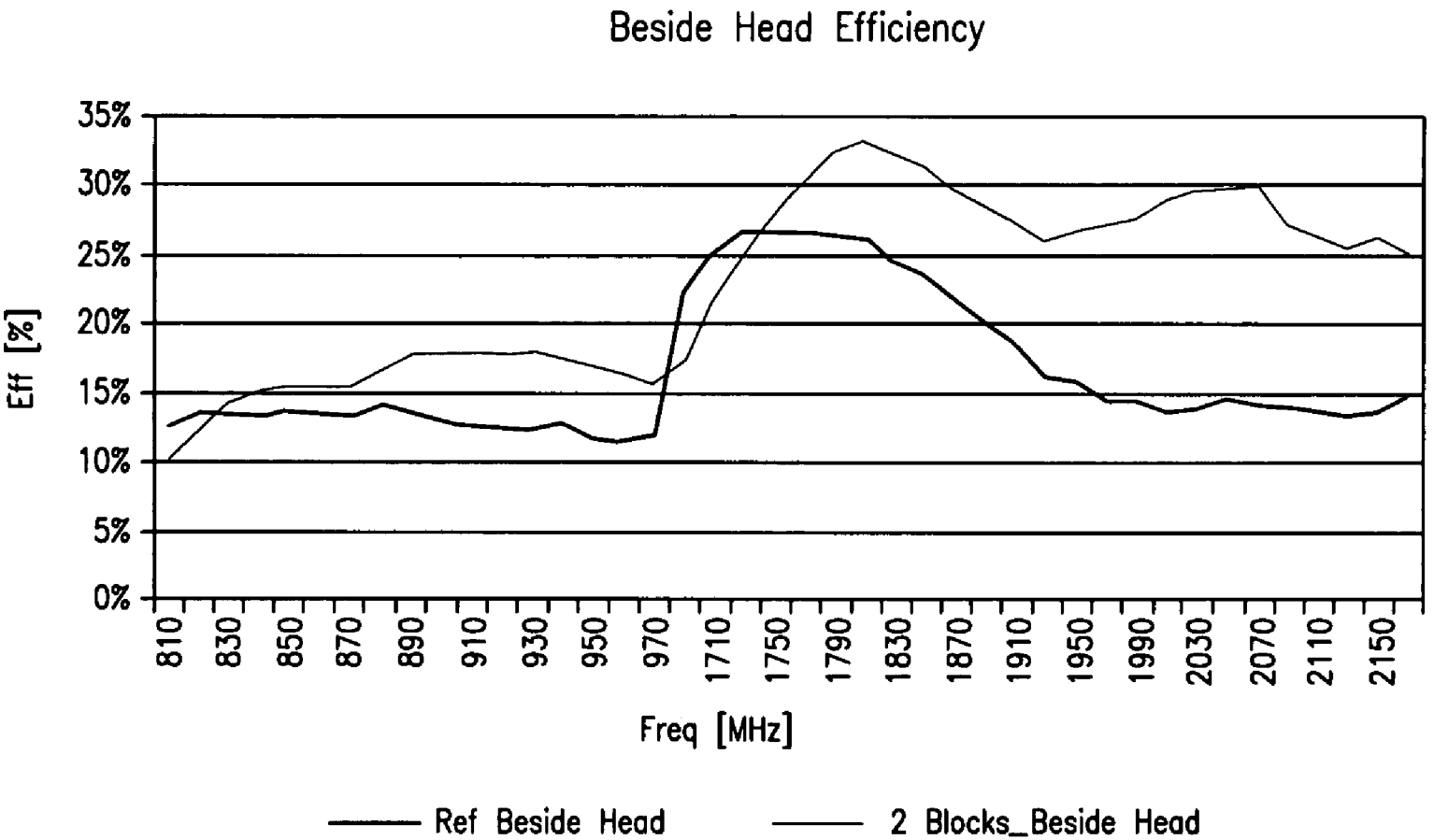
FIG. 9A is a plot of free space efficiency performance for one exemplary embodiment of the multi-band ceramic antenna of the present in a head-effected environment as compared to a prior art (reference) monopole antenna.
Figure 9B:
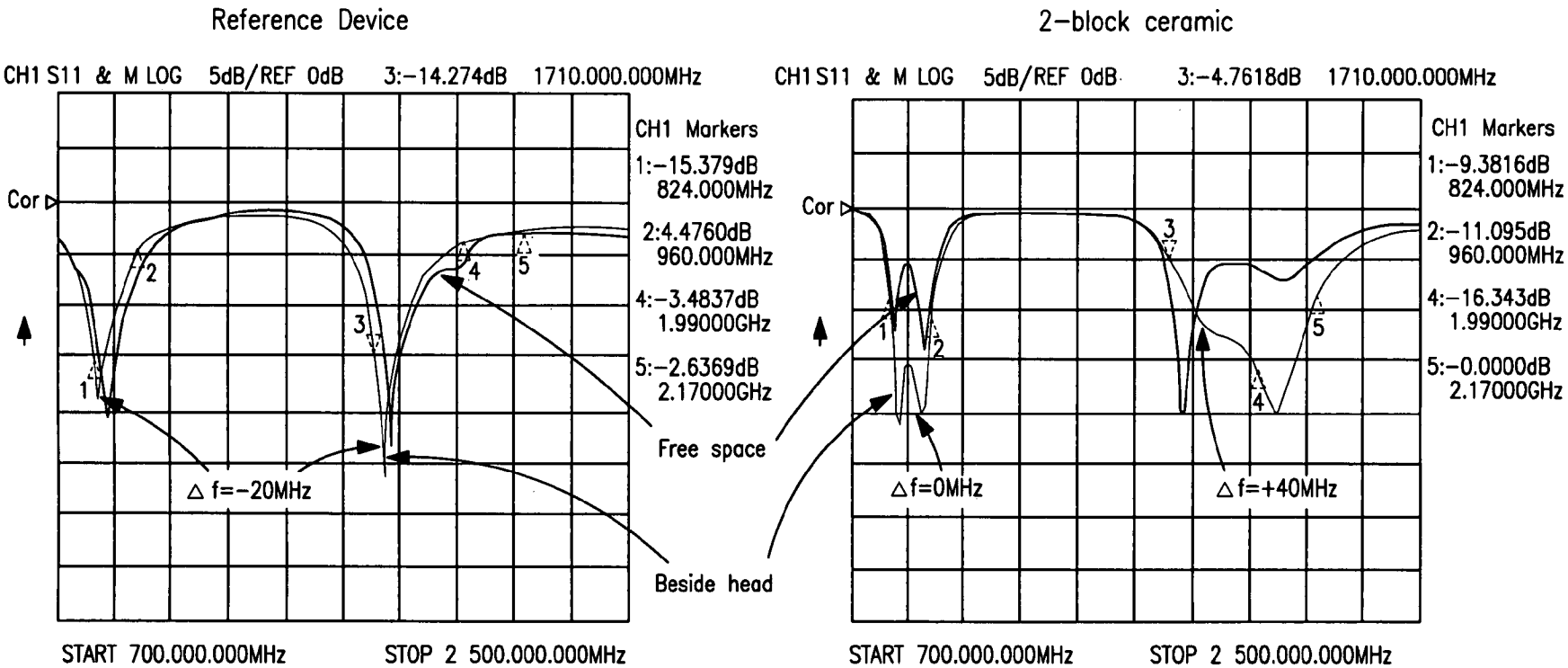
FIG. 9B is a plot of measured input return loss for the exemplary multi-band ceramic antenna embodiment of FIG. 9A as compared to the prior art monopole antenna showing head effects.

FIGS. 9A-9B illustrate a comparison of the performance of one exemplary embodiment of the multi-band antenna of the present invention (quad-band 2-block ceramic) versus a prior art reference design antenna utilized in a commercial product, in terms of the "head effect" (i.e., the change in antenna performance as a function of being placed proximate to a human head (or dummy representation thereof used for testing purposes) as would occur during normal use of the cellular telephone or other device incorporating the antenna.

As shown in FIG. 9A, the multi-band 2-block ceramic antenna embodiment of the present invention provides better free-space efficiency performance than the prior art reference device (monopole antenna) in a head-effected environment.

As shown in FIG. 9B, the multi-band 2-block ceramic antenna embodiment of the present invention provides better measured input return loss performance than the prior art reference device (including, inter alia, lower "detuning" or frequency shift) in a head-effected environment.

Figure 9C:
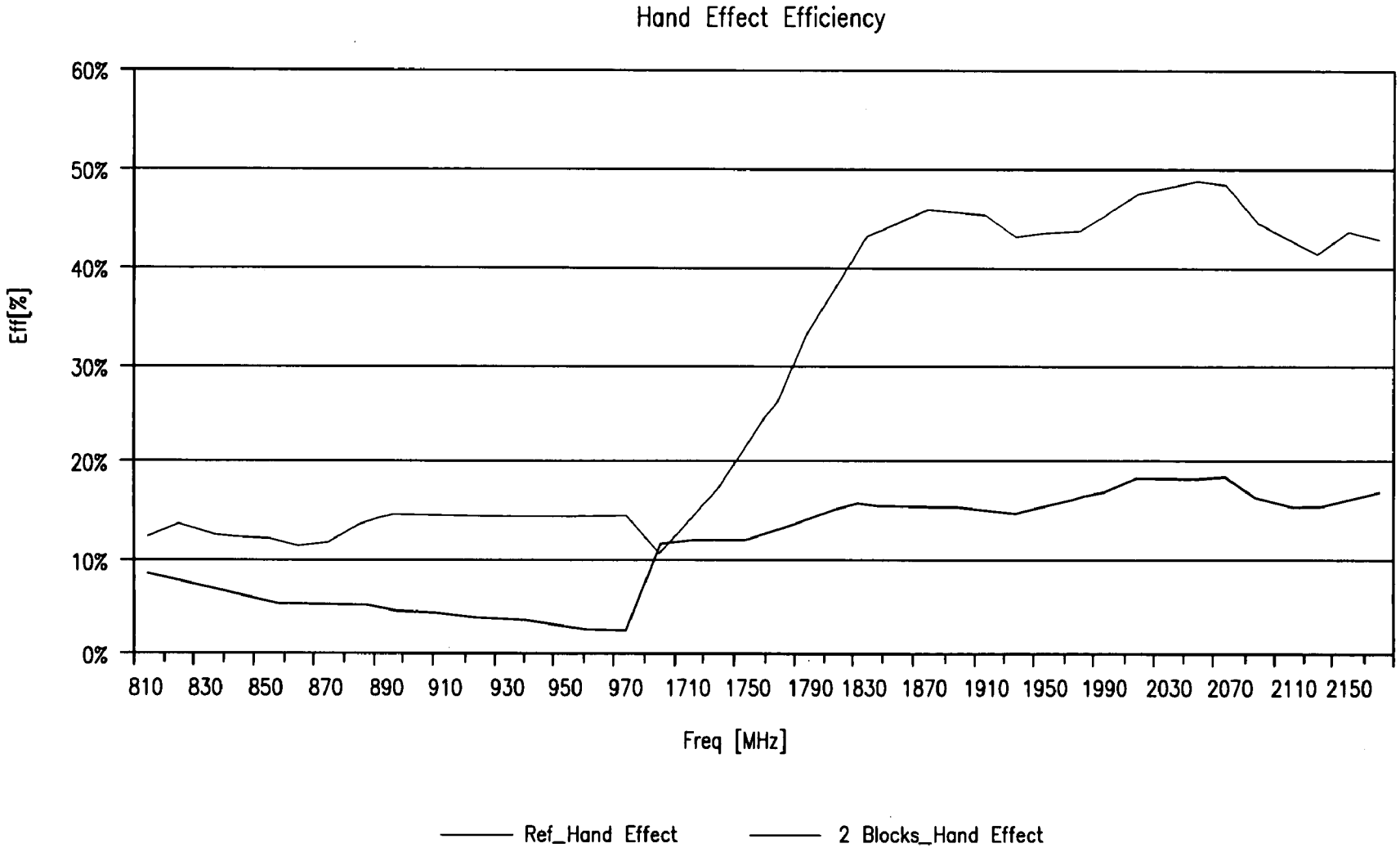
FIG. 9C is a plot of free space efficiency performance for one exemplary embodiment of the multi-band ceramic antenna of the present in a hand-effected environment as compared to a prior art (reference) monopole antenna.
Figure 9D:
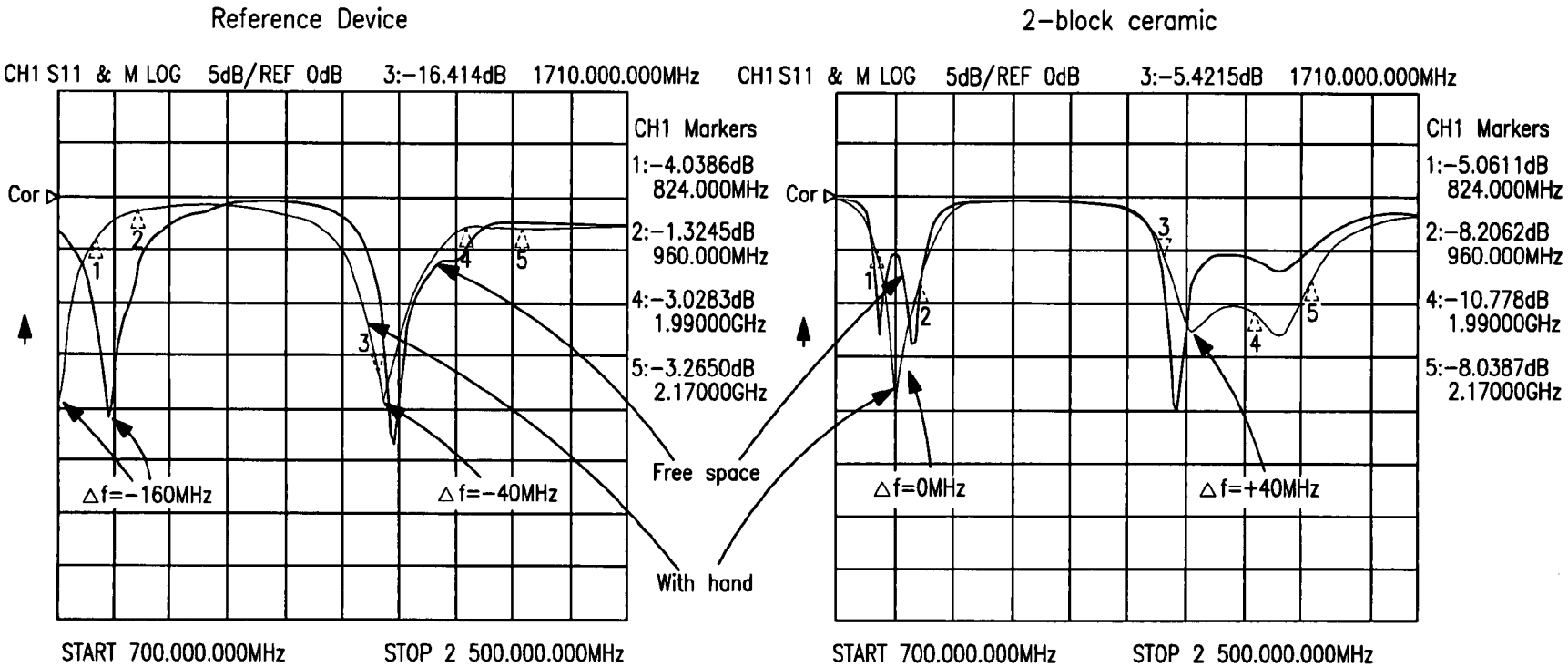
FIG. 9D is a plot of measured input return loss for the exemplary multi-band ceramic antenna embodiment of FIG. 9C as compared to the prior art monopole antenna showing hand effects.

Similarly, FIGS. 9C-9D illustrate a comparison of the performance of the exemplary embodiment of the multi-band antenna of the present invention (quad-band 2-block ceramic of FIGS. 9A-9B) versus a prior art reference design antenna utilized in a commercial product, in terms of the "hand effect" (i.e., the change in antenna performance as a function of being held in a human hand (or dummy representation thereof used for testing purposes) as would occur during normal use of the cellular telephone or other device incorporating the antenna.

As shown in FIG. 9C, the multi-band 2-block ceramic antenna embodiment of the present invention provides better free-space efficiency performance than the prior art reference device in a hand-effected environment.

As shown in FIG. 9D, the multi-band 2-block ceramic antenna embodiment of the present invention provides better measured input return loss performance than the prior art reference device (including, inter alia, lower "detuning" or frequency shift) in a hand-effected environment.

Methods—

Figure 10:
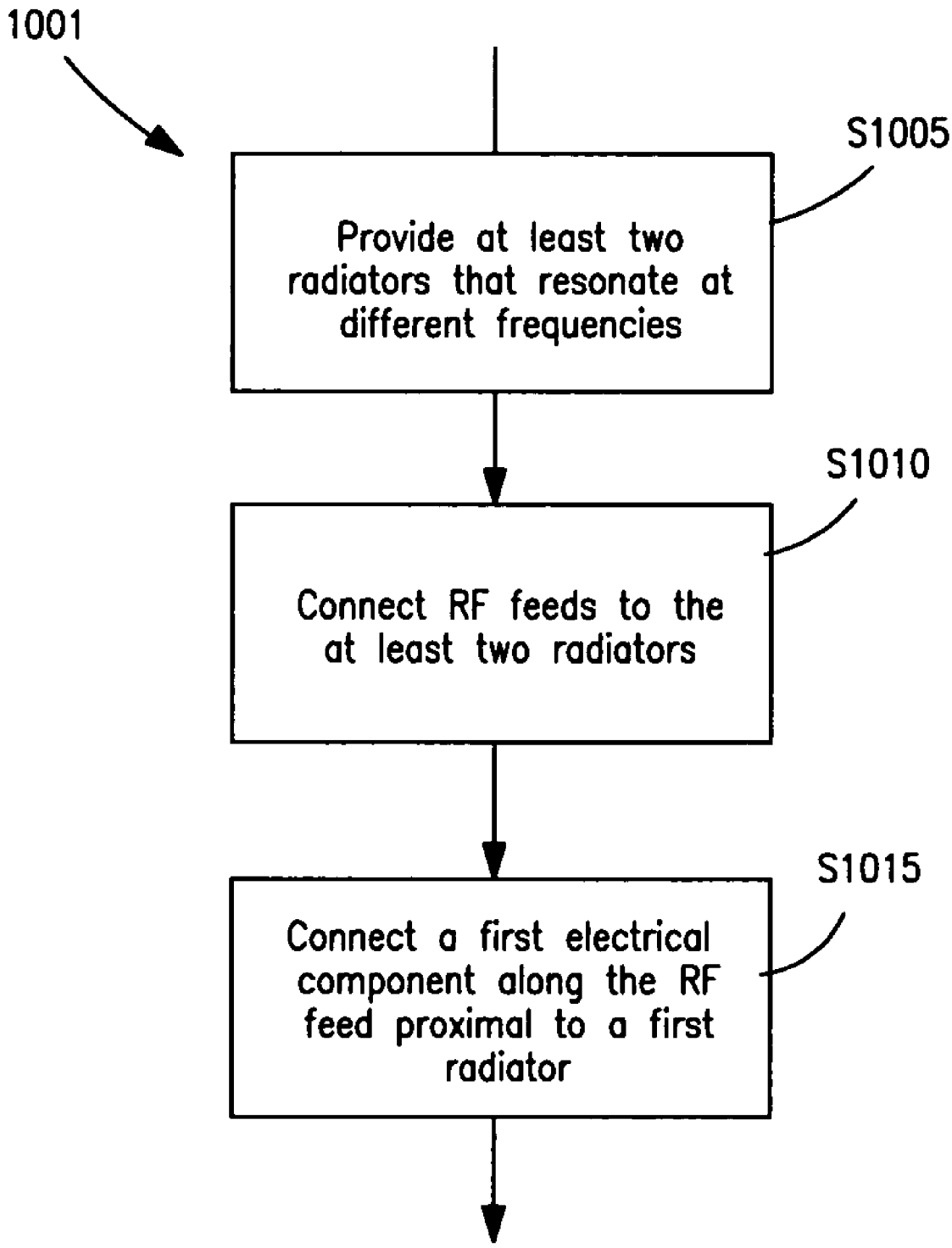
FIG. 10 is a logical flow diagram illustrating one exemplary embodiment of the method of producing a multi-band antenna in accordance with invention.

FIG. 10 is a logical flow diagram (1001) illustrating one embodiment of the method of producing a multi-band antenna in accordance with the present invention. This process results in a device with increased effective bandwidth, as previously described.

The exemplary method comprises first the step of providing at least two radiators that resonate at different frequency bands (S1005). As previously described, these may comprise ceramic or other types of devices suitable for the particular application for which the antenna is intended.

Next, the RF feed is connected to the at least two radiators to form a common junction network (S1010). This can be accomplished via any number of techniques including e.g., soldering, deposition coating, use of discrete conductors (e.g., wires, metallic strips, etc.), or any number of other possible approaches known to those of ordinary skill.

Finally, a first electrical component (e.g., a capacitor) is coupled along the RF feed proximate to a first radiator of the at least two radiators to add an adjacent frequency band to a first frequency band of the first radiator (S1015).

Furthermore, the method may further comprise the additional step of connecting a second electrical component coupled to the common junction network and proximately located to a second radiator of the at least two radiators. In one alternative embodiment of this step, the second electrical component, for example, creates a resonance with the common junction network to add a fourth frequency band proximate to a second frequency band as previously discussed.

It is noted that many variations of the methods described above may be utilized consistent with the present invention. Specifically, certain steps are optional and may be performed or deleted as desired. Similarly, other steps (such as additional data sampling, processing, filtration, calibration, or mathematical analysis for example) may be added to the foregoing embodiments. Additionally, the order of performance of certain steps may be permuted, or performed in parallel (or series) if desired. Hence, the foregoing embodiments are merely illustrative of the broader methods of the invention disclosed herein.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A multi-band antenna comprising:

a common junction network having a first radiator and a second radiator, the first radiator being adapted to resonate in a first frequency band and the second radiator being adapted to resonate in a second frequency band; and a first electrical component coupled to the common junction network, the first electrical component being adapted to create a resonance with the common junction network to provide a third frequency band;

wherein the first radiator is capable of communicating RF energy in the first frequency band and the third frequency band; and wherein the common junction network comprises a first radio frequency (RF) feed structure that couples to the first radiator, and a second RF feed structure that couples to the second radiator.

2. The antenna of claim 1, wherein said third band is substantially proximate in frequency to the first frequency band.

3. The antenna of claim 1, wherein the first frequency band and the second frequency band do not overlap one another.

4. The antenna of claim 3, wherein the first electrical component is located proximate to the first radiator on a substrate.

5. The antenna of claim 1, wherein the first electrical component comprises a charge storage device.

6. The antenna of claim 1, wherein the first radiator and the second radiator comprise a ceramic resonance element that is capable of being tuned in frequency.

7. The antenna of claim 1, wherein the first radiator resonates in a frequency range centered at approximately 850 MHz, and the second radiator resonates in a frequency range centered at approximately 1800 MHz.

8. The antenna of claim 7, wherein the first electrical component creates a resonance having a center frequency of approximately 900 MHz.

9. The antenna of claim 1, wherein the first electrical component is grounded at a first end distal from a second end that is coupled to the common junction network.

10. The antenna of claim 1, wherein the first radiator and the second radiator comprise patch antennas.

11. A multi-band antenna comprising:

a common junction network having a first radiator and a second radiator, the first radiator being adapted to resonate in a first frequency band and the second radiator being adapted to resonate in a second frequency band;

a first electrical component coupled to the common junction network, the first electrical component being adapted to create a resonance with the common junction network to provide a third frequency band; and a second electrical component coupled to the common junction network and proximately located to the second radiator, the second electrical component adapted to create a resonance with the common junction network so as to provide a fourth frequency band proximate to the second frequency band;

wherein the first radiator is capable of communicating RF energy in the first frequency band and the third frequency band and the second radiator is capable of communicating radio frequency energy in the second frequency band and the fourth frequency band.

12. The antenna of claim 11, wherein the fourth frequency band comprises a centerband frequency of approximately 1900 MHz.

13. A method for increasing an effective bandwidth of a multi-band antenna comprising:

providing at least two radiators that resonate in first and second frequency bands respectively;

connecting an RF feed to the at least two radiators to form a common junction RF network;

connecting a first electrical component along the RF feed proximate to a first radiator of the at least two radiators to add a third frequency band; and connecting a second electrical component coupled to the common junction RF network and proximately located to a second radiator of the at least two radiators, the second electrical component selected to create a resonance with the common junction RF network to provide a fourth frequency band.

14. The method of claim 13, wherein said third frequency band is substantially proximate in frequency to at least one of said first and second frequency bands.

15. The method of claim 14, wherein connecting the first electrical component comprises connecting a capacitor at one end to the RF feed proximately located to a first of said at least two radiators.

16. The method of claim 13, wherein providing the at least two radiators comprises providing at least one ceramic resonance element capable of frequency tuning for each of the at least two radiators.

17. A multi-band antenna adapted for use in a mobile wireless device useful in a plurality of wireless networks, the antenna comprising:

a network having first and second radiating elements resonant in first and second frequency bands, respectively, said network further comprising a first radio frequency (RF) feed structure that couples to the first radiating element and a second RF feed structure that couples to the second radiating element; and a first electrical component coupled to the network and adapted to create a resonance with the network to provide a third frequency band;

wherein the first radiating element is capable of at least one of transmitting or receiving radio frequency energy in the first frequency band and the third frequency band; and wherein at least two of the first, second, and third frequency bands comprise bands associated with different air interface standards.

18. The antenna of claim 17, wherein said at least two air interface standards comprise: (i) a GSM or UMTS related cellular standard; and (ii) a CDMA cellular standard, respectively.

19. The antenna of claim 17, wherein said at least two air interface standards comprise: (i) a WiFi standard; and (ii) a Bluetooth standard, respectively.

20. The antenna of claim 17, wherein said third band is substantially proximate in frequency to the first frequency band.

21. The antenna of claim 17, wherein the first frequency band and the second frequency band do not overlap one another.

22. The antenna of claim 21, wherein the first electrical component is located proximate to the first radiator on a substrate.

23. The antenna of claim 17, wherein the first electrical component comprises a charge storage device.

24. The antenna of claim 17, wherein the first radiator and the second radiator comprise a ceramic resonance element that is capable of being tuned in frequency.

25. The antenna of claim 17, wherein the first radiator resonates in a frequency range centered at approximately 850 MHz, and the second radiator resonates in a frequency range centered at approximately 1800 MHz.

26. The antenna of claim 25, wherein the first electrical component creates a resonance having a center frequency of approximately 900 MHz.

27. The antenna of claim 17, wherein the first electrical component is grounded at a first end distal from a second end that is coupled to the common junction network.

28. The antenna of claim 17, wherein the first radiator and the second radiator comprise patch antennas.

29. A wireless mobile device, comprising:

a processor;

a storage device in signal communication with said processor;

a radio frequency transceiver in signal communication with said processor; and a multi-band antenna in signal communication with said transceiver, said antenna comprising:

a common junction network having a first radiator and a second radiator, the first radiator being adapted to resonate in a first frequency band and the second radiator being adapted to resonate in a second frequency band, the common junction network further comprising a first radio frequency (RF) feed structure that couples to the first radiator, and a second RF feed structure that couples to the second radiator; and a first electrical component coupled to the common junction network, the first electrical component being adapted to create a resonance with the common junction network to provide a third frequency band;

wherein the first radiator is capable of communicating RF energy in the first frequency band and the third frequency band.

30. A multi-band radio frequency identification device (RFID) device, comprising:

a processor;

a storage device in communication with said processor and adapted to store information substantially unique to said RFID device;

a transceiver;

a substantially flexible substrate; and a multi-band antenna in signal communication with said transceiver, said antenna comprising:

a common junction network having a first radiator and a second radiator, the first radiator being adapted to resonate in a first frequency band and the second radiator being adapted to resonate in a second frequency band, the common junction network further comprising a first radio frequency (RF) feed structure that couples to the first radiator, and a second RF feed structure that couples to the second radiator; and a first electrical component coupled to the common junction network, the first electrical component being adapted to create a resonance with the common junction network to provide a third frequency band;

wherein the first radiator is capable of communicating RF energy in the first frequency band and the third frequency band.

* * * * *